US008112835B2

(12) United States Patent
Eirich et al.

(10) Patent No.: US 8,112,835 B2
(45) Date of Patent: Feb. 14, 2012

(54) BASSINET WITH HEIGHT ADJUSTABLE WALL

(75) Inventors: Rachel Eirich, Collegeville, PA (US); John (Jason) C. Arnold, IV, Philadelphia, PA (US); Matthew Rivera, Mableton, GA (US); Annette Stella, Downingtown, PA (US)

(73) Assignee: Graco Children's Products Inc., Atlanta, GA (US)

( * ) Notice: Subject to any disclaimer, the term of this patent is extended or adjusted under 35 U.S.C. 154(b) by 0 days.

(21) Appl. No.: 12/725,238

(22) Filed: Mar. 16, 2010

(65) Prior Publication Data

US 2010/0229300 A1 Sep. 16, 2010

Related U.S. Application Data

(60) Provisional application No. 61/160,614, filed on Mar. 16, 2009, provisional application No. 61/247,528, filed on Sep. 30, 2009.

(51) Int. Cl.
*A47D 7/00* (2006.01)

(52) U.S. Cl. ..... 5/93.1; 5/93.2; 5/98.1

(58) Field of Classification Search ..... 5/93.1, 5/93.2, 98.1, 2.1, 101, 103, 105, 133, 134, 5/137, 138

See application file for complete search history.

(56) References Cited

U.S. PATENT DOCUMENTS

| | | | | |
|---|---|---|---|---|
| 3,648,307 | A * | 3/1972 | Meade | 5/93.1 |
| 3,761,969 | A * | 10/1973 | Meade | 5/93.1 |
| 5,148,561 | A | 9/1992 | Tharalson et al. | |
| 5,172,435 | A | 12/1992 | Griffin et al. | |
| 5,553,337 | A * | 9/1996 | Lin | 5/93.2 |
| 6,263,526 | B1 * | 7/2001 | Tu | 5/109 |
| 6,901,613 | B1 * | 6/2005 | Hsia | 5/93.1 |
| 7,685,657 | B1 * | 3/2010 | Hernandez et al. | 5/101 |
| 7,770,245 | B2 * | 8/2010 | Cheng et al. | 5/93.1 |
| 2002/0157180 | A1 * | 10/2002 | Koenig et al. | 5/93.1 |
| 2004/0181873 | A1 * | 9/2004 | Waldman et al. | 5/101 |
| 2004/0187207 | A1 * | 9/2004 | Hsia | 5/93.1 |
| 2004/0244111 | A1 * | 12/2004 | Williams | 5/109 |
| 2008/0022457 | A1 * | 1/2008 | Wu | 5/99.1 |
| 2009/0049605 | A1 * | 2/2009 | Zhao et al. | 5/93.1 |
| 2009/0056013 | A1 * | 3/2009 | Hartenstine et al. | 5/93.1 |

OTHER PUBLICATIONS

Owner's Manual, Graco Pack 'N Play Playard with Newborn Napper, www.gracobaby.com, 56 pages (Oct. 2008).

Instruction Manual, Arm's Reach Original Co-Sleeper Bassinet, 13 pages (Nov. 2001).

* cited by examiner

*Primary Examiner* — Robert G Santos
*Assistant Examiner* — Brittany Wilson
(74) *Attorney, Agent, or Firm* — Lempia Summerfield Katz LLC

(57) ABSTRACT

A bassinet includes a frame and a bed basket supported by the frame. The bed basket defines an infant sleep surface. The frame and the bed basket are pivotably coupled to allow the bed basket to rotate relative to the frame to convert between a first bassinet configuration and a second bassinet configuration. The second bassinet configuration has a greater wall height about the infant sleep surface than the first bassinet configuration.

19 Claims, 21 Drawing Sheets

FIG. 12A
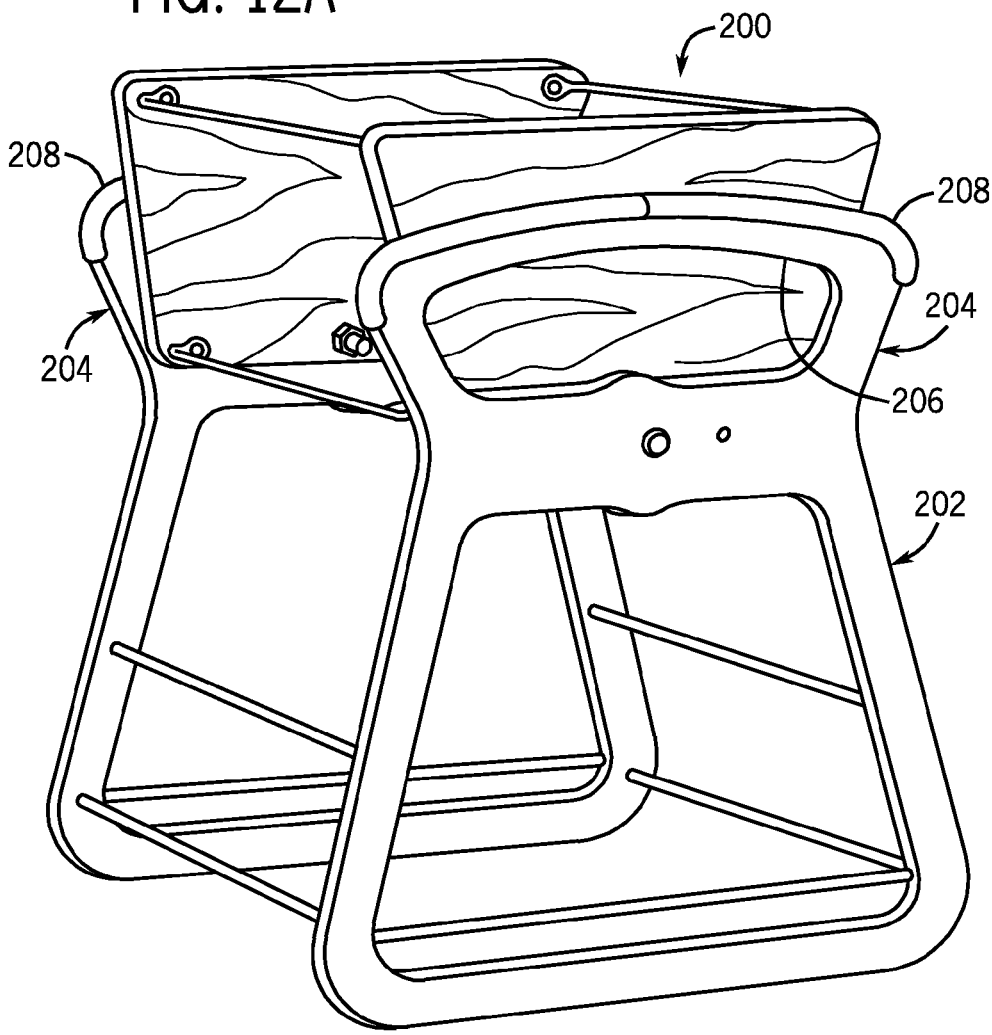
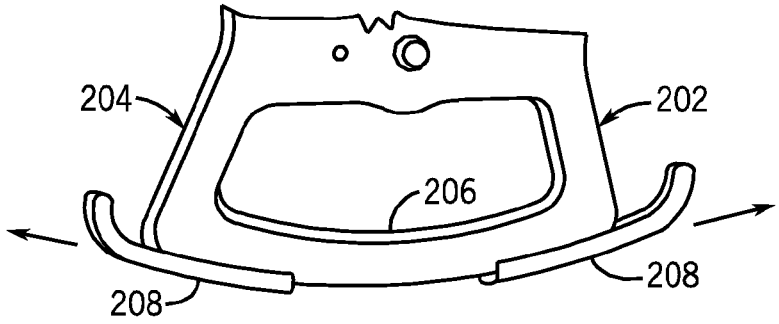
FIG. 12B

BASSINET WITH HEIGHT ADJUSTABLE WALL

CROSS-REFERENCES TO RELATED APPLICATIONS

This application claims the benefit of U.S. provisional application entitled "Bassinet with Height Adjustable Wall," filed Mar. 16, 2009, and assigned Ser. No. 61/160,614, and U.S. provisional application entitled "Bassinet with Height Adjustable Wall," filed Sep. 30, 2009, and assigned Ser. No. 61/247,528, the entire disclosures of which are hereby expressly incorporated by reference.

BACKGROUND OF DISCLOSURE

1. Field of the Disclosure

The present disclosure is generally directed to bassinets, and more particularly to adjustable bassinets.

2. Description of Related Art

A typical bassinet is constructed to accommodate an infant through the age of three months, the infant development period referred to as "stage one." During that time period, caregivers usually place the bassinet outside of the nursery, often in another bedroom where the caregiver sleeps. However, many parents are inclined to continue this sleeping arrangement beyond the first three months. Indeed, medical research has expressed the benefits of continuing the sleeping arrangement for an extended time. However, once the infant reaches three months of age, the infant can or soon will be capable of pushing up on hands or knees. As a result, child safety compliance standards state that the wall height of a bassinet, crib, or playard should increase from 8-10 inches for a stage one child to 20 inches for infant children around three months old or 15 lbs, the development period referred to as stage two.

One common approach to addressing the stage one to stage two transition involves temporarily setting up a crib in the caregiver bedroom. Unfortunately, cribs are typically too large to fit through a doorway after assembly. As a result, the crib is first assembled in the parent bedroom, and then later disassembled and reassembled when the child begins to sleep in the nursery.

Another solution adopted by parents involves the use of a playard. Some commercially available playards can be equipped with a bassinet directed to stage one. Once the infant exceeds the weight/age limits of the bassinet, the bassinet is removed, and the infant is placed on the primary, lower surface of the playard. As a result, the infant is surrounded by the panels of the playard, thereby exceeding the minimum wall height requirement. One example of these playard-bassinet combinations is the Graco Pack'n Play with Newborn Napper, which provides yet another sleep surface over the bassinet for a newborn. The Newborn Napper attaches to the bassinet to reduce the sleep surface footprint for the newborn infant.

Another example of the playard-bassinet combination is available from Arms Reach, which manufacturers a playard-like bassinet that has a drop-down side wall. The drop-down wall is primarily employed to provide better access to the infant for night-time feeding.

Many cribs, bassinets, and most playards have walls that make placement and/or removal of a child difficult. These cribs, bassinets and, and playards frequently have tall side walls and/or a sleep surface that is close to the ground, forcing a caregiver to bend over significantly to attend to the child. Many of these products also employ removable components in an attempt to accommodate a broad age range. Unfortunately, these components may be lost and complicate the assembly of the product.

SUMMARY OF THE DISCLOSURE

In accordance with one aspect of the disclosure, a bassinet includes a frame, and a bed basket supported by the frame, the bed basket defining an infant sleep surface. The frame and the bed basket are pivotably coupled to allow the bed basket to rotate relative to the frame to convert between a first bassinet configuration and a second bassinet configuration. The second bassinet configuration has a greater wall height about the infant sleep surface than the first bassinet configuration.

In some cases, the bed basket is inverted relative to the frame to convert between the first and second bassinet configurations.

The frame may include a pair of stands. Each stand may be inverted relative to a rest surface to convert between the first and second bassinet configurations. The bed basket may be inverted relative to each stand to convert between the first and second bassinet configurations.

In some cases, the bassinet also includes a pivot shaft that couples the bed basket and the frame. Alternatively or additionally, the bassinet also includes a storage basket. The storage basket may include soft goods suspended from the frame. The bed basket may be inverted relative to the frame and the frame is inverted relative to a rest surface to convert from the first bassinet configuration to the second bassinet configuration in which the soft goods of the storage basket form a wall structure about the infant sleep surface.

BRIEF DESCRIPTION OF THE DRAWINGS

Objects, features, and advantages of the present invention will become apparent upon reading the following description in conjunction with the drawing figures, in which like reference numerals identify like elements in the figures.

FIG. 12A is a perspective view of a bassinet frame constructed in accordance with an alternative embodiment.

FIG. 12B is a partial perspective view of the bassinet frame of FIG. 12A to show an adjustable rocker base in greater detail.

DETAILED DESCRIPTION OF THE DISCLOSURE

Figure 1:
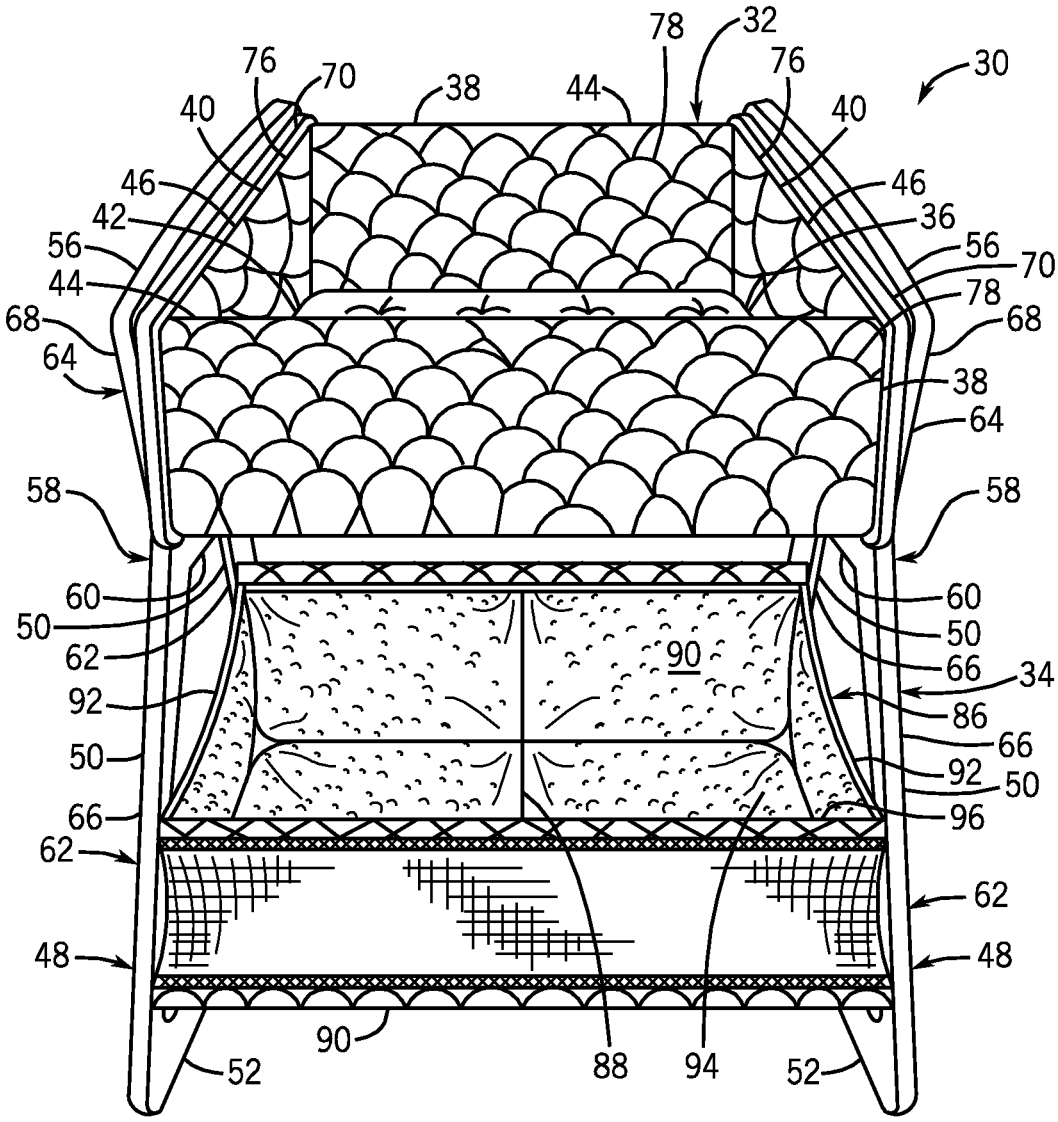
FIG. 1 is a front side, perspective view of an exemplary bassinet constructed in accordance with several aspects of the disclosure and configured in a first stage orientation.

The disclosure is generally directed to bassinets that are adjustable or reconfigurable to accommodate a wide infant age range and, thus, multiple stages of infant development. The adjustment of the disclosed bassinets generally involves increasing the height of walls structures (e.g., side panels or other walls) to create a deeper sleeping area or space so that the bassinet remains appropriate for infants beyond stage one development (0-3 months). As a result, caregivers who wish to keep an infant in the caregiver bedroom need not rely on a full-size crib or playard when the infant transitions from stage one to stage two (3-9 months). The disclosed bassinets instead provide a non-full size crib solution that nonetheless presents a deeper sleeping space or area with higher side walls for safety during stage two.

Several of the examples described below are converted between the stage one and stage two orientations via a rotatable bed basket and an invertible frame assembly. In some cases, the disclosed bassinets include a frame and a bed basket rotatably coupled to the frame. To switch between the orientations, the bed basket is rotated relative to the frame to an upside down (or inverted) position, and then the frame is also inverted (or flipped over), which reverts the bed basket to an upright position. Because the rotation axis of the bed basket is offset from the center of the frame, flipping the frame changes the depth of the sleeping space.

One challenge addressed by the disclosed bassinets involves avoiding a significantly lower infant sleep surface despite the increase in wall height. In this way, the infant can be easily placed and removed from the bassinet without forcing the caregiver to bend over and strain to access the infant. In some of the examples described below, the infant sleep surface remains at the same height (or nearly the same height) relative to the rest surface despite the adjustment to the surrounding walls.

One benefit of the disclosed bassinets is that the adjustability is achieved without adding or removing components of the bassinet. This feature avoids the common scenario in which components separated from the rest of the product are lost over the time period, often months, between adjustments.

The disclosed bassinets may include a locking mechanism to selectively maintain the bassinet in either the first or second stage orientation or configuration. In some cases, the locking (or unlocking) mechanism can be operated with one hand. To that end, the mechanism may be located at or near a hub or other rotation joint. Alternatively or additionally, the mechanism may be located at or near the midpoint of a cross bar or brace as described below. These and other aspects of the disclosed bassinets lead to the convenient nature in which the transition from the first infant stage to the second infant stage can be made. In some cases, the adjustment can be achieved with a single hand.

The disclosed bassinets may include a storage basket or space. In some cases, the storage space becomes part of the infant sleep space when the bassinet is converted to the second stage orientation. To that end, the storage space may be defined by portions of the frame and/or soft goods that define the walls of the infant sleep space of the second stage orientation.

Figure 2:
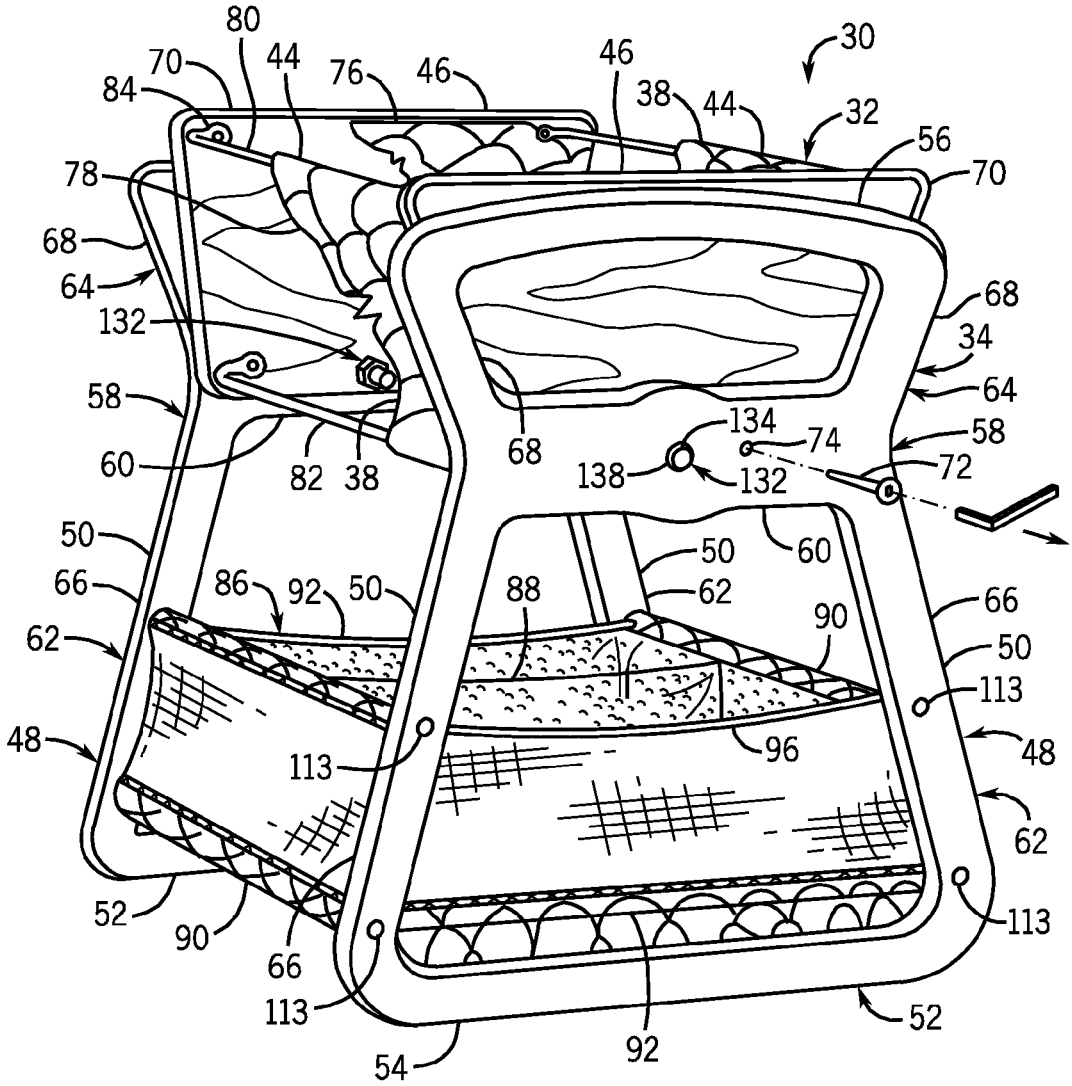
FIG. 2 is an end side, perspective view of the bassinet of FIG. 1 shown with portions of soft goods removed to reveal structural components of an exemplary frame.

Turning now to the drawing figures, FIGS. 1 and 2 show a bassinet 30 configured for convertibility between first and second stage orientations or configurations. The bassinet 30 includes a bed basket 32 and a frame assembly 34 that structurally supports the bed basket 32 above a rest surface. The bed basket 32 generally defines a sleep surface or bed 36 (FIG. 1) for the infant. The space contained by the bassinet 30 (e.g., the sleep space or infant space) above the bed 36 varies based on the orientation of the bassinet 30. The bed basket 32 may be generally box-shaped and enclosed with the exception of an open top. In this example, the bed basket 32 has a pair of opposed side walls 38 and a pair of opposed end walls 40 that together form a wall structure that surrounds the bed 36 and defines a perimeter thereof. The basket side walls 38 and the basket end walls 40 extend upward from a bottom 42 of the bed basket 32 to reach opposed pairs of upper edges 44, 46, respectively. Together, the upper edges 44, 46 define an upper or top rim of the bed basket 32. The bottom 42 of the bed basket 32 may include a mattress or other soft goods, as described and shown below. In this example, the bed basket 32 is slightly wider between the side walls 38 at the top rim than at the bottom 42. To that end, the basket side walls 38 may be oriented at an angle, leaning outward from the bottom 42 as shown in FIG. 2.

The bassinet 30 is shown in FIGS. 1 and 2 oriented in a first infant stage configuration. In this example, the height of the infant sleep space in the first infant stage configuration corresponds with the height of the above-described wall structure defined by the basket side walls 38 and the basket end walls 40. That is, the infant experiences a wall height equal to the distance from the bottom 42 to the upper edges 44, 46, or top rim, of the bed basket 32. In some cases, the wall height of the infant sleep space may be, for example, about 8-10 inches.

The frame assembly 34 is generally configured to provide structural support for the bed basket 32 and enable the adjustment of the bassinet 30 between the first and second stage orientations. In this example, the frame assembly 34 includes a pair of end stands 48 spaced apart from one another generally by the width of the bed basket 32. The end stands 48 are, thus, vertically oriented in respective, parallel planes disposed along or adjacent to the end walls 40 of the bed basket 32. The plane of each end stand 48 is disposed laterally outward of the plane of the basket end wall 40 to which it is adjacent. Thus, the spacing of the end stands 48 generally defines the width of the footprint of the bassinet 30. Each end stand 48 includes a pair of uprights or legs 50 and a base 52 from which the uprights 50 generally extend upward. The base 52 of each end stand 48 includes a lower cross beam 54 that connects the uprights 50 at or near lower ends thereof. As a result, the lower cross beam 54 may act as a foundation or rail (e.g., a footer or a rocker) when the bassinet 30 is configured in the stage one orientation as shown, i.e., when the base 52 is in contact with the rest surface. The uprights 50 are also connected at their upper ends by an upper cross beam 56 and at a neck section 58 of each stand 48 by a middle cross beam 60. As described below, the upper cross beam 56 may also act as a foundation or rail when the bassinet 30 is oriented in a stage two configuration. Each of the beams 54, 56, and 60 act as cross braces to provide rigidity to the stand 48.

The neck section 58 separates the stand 48 into two support sections, a short support section 62, and a long support section 64. In the first stage orientation shown, the long support sections 64 act as support legs. In contrast, in the second stage orientation, the long support sections 64 become supports for the wall structure for the infant space, while the short support sections 62 act as support legs as described below. The support sections 64, 62 are defined by linear segments 66, 68 of each upright 50, respectively. The linear segments 66 are disposed between and connect the base 52 and the neck section 58. From the neck section 58, the other linear segments 68 are disposed between and connect the neck section 58 and the upper cross beam 56. Each linear segment 66 is longer than each linear segment 68, thereby resulting in the length difference between the short and long support sections 62, 64. As a further result of this relative difference in length, the neck section 58 and the middle cross beam 60 are offset from the midpoint of the stand 48. That is, the neck section 58 and the middle cross beam 60 are closer to the upper cross beam 56 than the lower cross beam 54.

The beams 54, 56, 60 and the uprights 50 may be formed as integral components of each end stand 48. For example, each end stand 48 may have a wooden or molded composition, and each of the aforementioned components may be shaped as slats or strips cut or formed in the desired shapes.

As best shown in FIG. 2, the linear segments 66, 68 may be oriented at an angle to increase the depth (or width) of the cross beams 54, 56, and, thus, provide a broader foundation in either of the orientations of the bassinet 30. In this example, the linear segments 66 are oriented at an angle to slope outward, or away from, the other upright 50 within the plane of the stand 48 as they extend downward from the neck section 58. The other linear segments 68 are also oriented at an angle with respect to vertical, and similarly angle outward as they extend upward from the neck section 58. The segments 66, 68 may be offset from vertical by equal but opposite angles. With these angled orientations of the segments 66, 68, the pair of uprights 50 define an hour-glass shaped outline of each end stand 48.

The bed basket 32 is adjustably coupled to the frame 34 via one or more connections between the stands 48 and the bed basket 32. To this end, each end wall 40 includes a rigid end panel 70. In the example of FIG. 2, a connection is secured via a fastener 72 (e.g., an Allen head or other screw fastener) that passes through a hole 74 in the neck section 58 to engage an aligned hole (not shown) in one of the end panels 70. To that end, the bed basket 32 and, thus, each of the end panels 70 are positioned at an elevation for overlap with at least part of the neck section 58. In this example, the bottom 42 of the bed basket 32 is disposed slightly below the midpoint of the cross beam 60 in the first stage orientation. The top rim of the basket 32 ends up roughly in line with, or at the same height of, the cross beam 56.

The end panels 70 may be disposed in a generally upright orientation. Thus, each end panel 70 is oriented in parallel with a respective one of the stands 40. The end panels 70 provide structural support for the end walls 46 and may be composed of wood as shown or other rigid materials. Each end panel 70 is positioned adjacent to, or laterally inward of, a respective one of the stands 40. As described below, each end panel 70 may be spaced from the respective stand 40 to allow the bed basket 32 to rotate relative to the frame 34.

A layer of soft goods 76 may be secured to or otherwise disposed along the interior face of each end panel 70. For example, quilting or other padded fabric may provide cushioning along the end walls 46 within the infant space defined by the wall structure of the bed basket 32. The soft goods layer 76 is shown partially cutaway in FIG. 2 to reveal the underlying end panel 70. Along the side walls 44, further quilt or other soft goods 78 are suspended from upper and lower lateral support rods 80, 82 (FIG. 2) that extend between the end panels 70. Each rod 80, 82 may have a looped end 84 (FIG. 2) to facilitate a secure connection with the end panel 70 via an appropriate fastener (not shown). The soft goods 78 may be looped over or around the rods 80, 82 with or without stitching. The soft goods 78 may also extend across the bottom 42 (FIG. 1) of the bed basket 32 to define or support a floor or other soft goods that, in turn, define the sleep surface or bed 36.

The side walls 38 and the end walls 40 of the bed basket 32 may be configured with a variety of different arrangements of soft goods and rigid components for a desired combination of comfort and structural support. Thus, the shape, size, and other characteristics of the above-described components of the bed basket 32 and the frame 34 may vary considerably from the example shown. For example, the stands 48 need not neck down via angled uprights. Instead, the uprights of each stand may be vertically oriented. Additional soft goods or support components may also be incorporated, including, for instance, support straps that extend across the bottom 42 of the bed basket 32. Each strap may wrap around or otherwise engage the lower rods or be stitched or otherwise attached to the soft goods of the side walls. A number of other alternatives are described below in connection with several alternative embodiments.

With continued reference to FIGS. 1 and 2, the bassinet 30 has a storage basket 86 disposed below the bed basket 32 in the first stage orientation. The storage basket 86 is largely defined by a soft goods arrangement suspended from the segments 66 of each stand 48. The storage basket 86 may be box-shaped and enclosed on all sides with the exception of an open top for access. The storage basket 86 may be separated by a divider 88 into a pair of adjacent storage spaces. Side walls 90 of the storage basket 86 extend between the stands 48, while end walls 92 extend between the uprights 50 of each one of the stands 48. Respective soft goods panels may be used to define the divider 88, the side walls 90, the end walls 92, and a bottom 94 (FIG. 1). As will become evident from the description below, a top rim 96 of the storage basket 86 may be spaced from the bottom 42 of the bed basket 32 by a distance equal to, or approximately equal to, a radial height of the bed basket 32.

Figure 3:
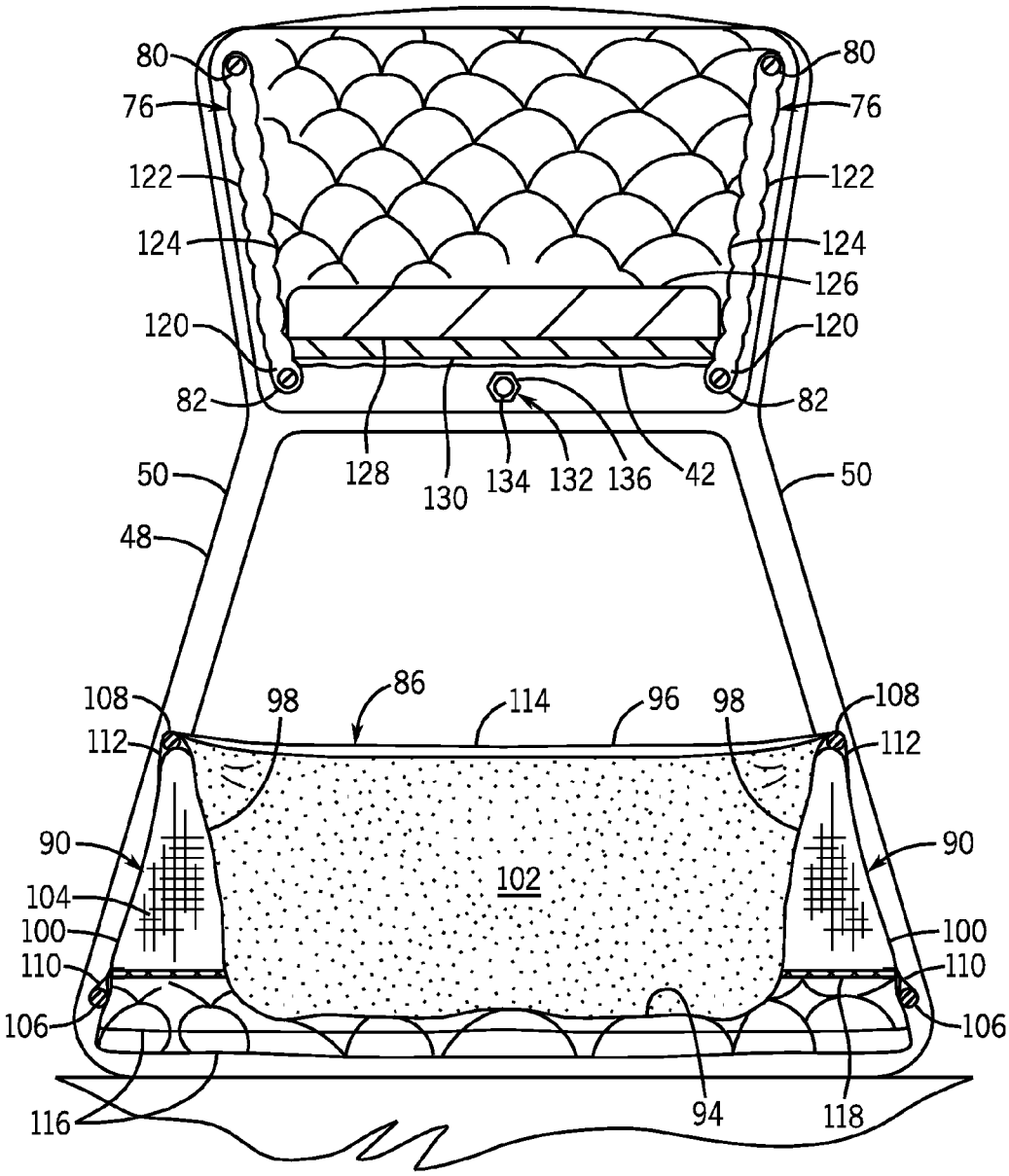
FIG. 3 is a sectional view of the bassinet of FIG. 1 to reveal sleep and storage spaces thereof made available in the first stage orientation.

With reference now to FIG. 3, each side wall 90 and end wall 92 of the storage basket 86 has a double-layered soft goods construction. The side walls 90 are schematically shown in the sectional view of FIG. 3 to reveal an interior layer 98 and an exterior layer 100. Further interior and exterior layers 102, 104 of one of the end walls 92 are also revealed. Each of these layers may be primarily composed of a mesh or other netting-like fabric material to provide a see-through appearance. The mesh portions of the soft goods of the interior and exterior layers may have the same or similar construction, but are depicted differently for ease in illustration.

In this example, the soft goods of the exterior layers 100 generally extend upward from lower rods 106 to reach upper rods 108, which may be captured in fabric loops or channels 110, 112. The exterior layers 100 may be angled inward as shown as they follow the orientation of the uprights 50 of the stand 48. The lower rods 106 and the upper rods 108 are connected between the end stands 48, thereby helping to define the two side walls of the basket 86. Screw or other fasteners 113 (FIG. 2) may be used to connect the rods 106, 108 to each end stand 48. After reaching the upper rods 108, the soft goods material of the interior layers 98, 102 generally fall downward to define the storage space of the basket 86. Along the side walls 90, the interior layers 98 may constitute a continuation of the fabric loops 112. Along the end walls 92, the interior layers 102 may fall downward from, and be stitched to, welting 114 stretched between, and secured to, the upper rods 108. The welting 114 may be used to define the transition between the interior and exterior layers 102, 104 along the end walls 92. In addition to the welting 114, the exterior layers 104 may further include one or more bands 116 of quilt or other fabric to secure each exterior layer 104 to the stand 48. The top-most quilt band 116 may be secured to the mesh of the exterior layer 104 via a line 118 of stitching. One of the bands 116 may also be configured as a fabric channel or loop in which a support rod (not shown) is captured. The support rod may be used to provide support for the soft goods suspended along the end walls of the storage basket 86, especially when the bassinet 30 is oriented in the stage two configuration described below, during which the end panel soft goods are suspended from the support rod.

FIG. 3 also depicts an exemplary arrangement of soft and hard goods in the bed basket 32. In this case, the quilt layers 76 include loops or channels 120 for attachment to the lower rods 82, as well as exterior sections 122 that extend up and over the upper rods 80. The quilt layers 76 then fall back downward, forming interior sections 124 that eventually define the bottom 42 of the bed basket 32. A mattress pad 126 is placed on the portion of the interior sections 124 lying on the basket bottom 42. The mattress pad 126 may be composed of a variety of layers for comfort and structural support, including, for instance, a foam or batting layer 128 and a stiffening panel or board 130. The stiffening panel 130 may be composed of medium density fiberboard (MDF) or plywood, and may be sewn into the mattress pad 126 to maintain a consistent position and orientation therein. The pad 126 and, more specifically, the board 130 rest upon the lower rods 82. An optional cross bar (not shown) may be connected between the lower rods 82 for additional support.

In accordance with one aspect of the disclosure, the bed basket 32 is rotationally adjustable relative to the frame 34 to allow a caregiver to reorient the bed basket 32 relative to the frame 34. Generally speaking, one or more connections between the bed basket 32 and the frame 34 are disengaged to allow the rotational adjustment to occur. In some cases, the bed basket 32 is rotationally coupled to the frame 34 to allow the bassinet 30 to be oriented in either the first or second stage configuration. In other cases, the bed basket 32 is completely disconnected from the frame 34 so that the caregiver can reassemble or reconnect the bed basket 32 in an inverted orientation. Thus, the adjustment need not rely on a rotational coupling.

As shown in FIGS. 2 and 3, in this example, each end panel 70 is rotationally coupled to a respective one of the end stands 48 via a pair of pivot assemblies 132. Each pivot assembly 132 includes a bolt 134 that passes through holes (not shown) in the neck 58 and the end panel 70. The bolts 134 and the holes are aligned along a common axis about which the bed basket 32 rotates. Each bolt 134 may be secured in position by a nut 136 (FIG. 3) on the inside face of the beam 60. One or more washers 138 (FIG. 2), spacers, bushings, or bearings may be used to support the rotational coupling. For example, a plastic insert (not shown) may provide a bearing surface for the bolt 134, as well as a support surface(s) for the locking fastener 72. More generally, the neck 58 (or the beam 60) acts as a pivot joint mount. To enable a rotational adjustment in this example, the fastener 72 (FIG. 2) is disengaged from the end panel 70, such that the panel 70 is free to rotate about the axis defined by the bolts 134.

Figure 4:
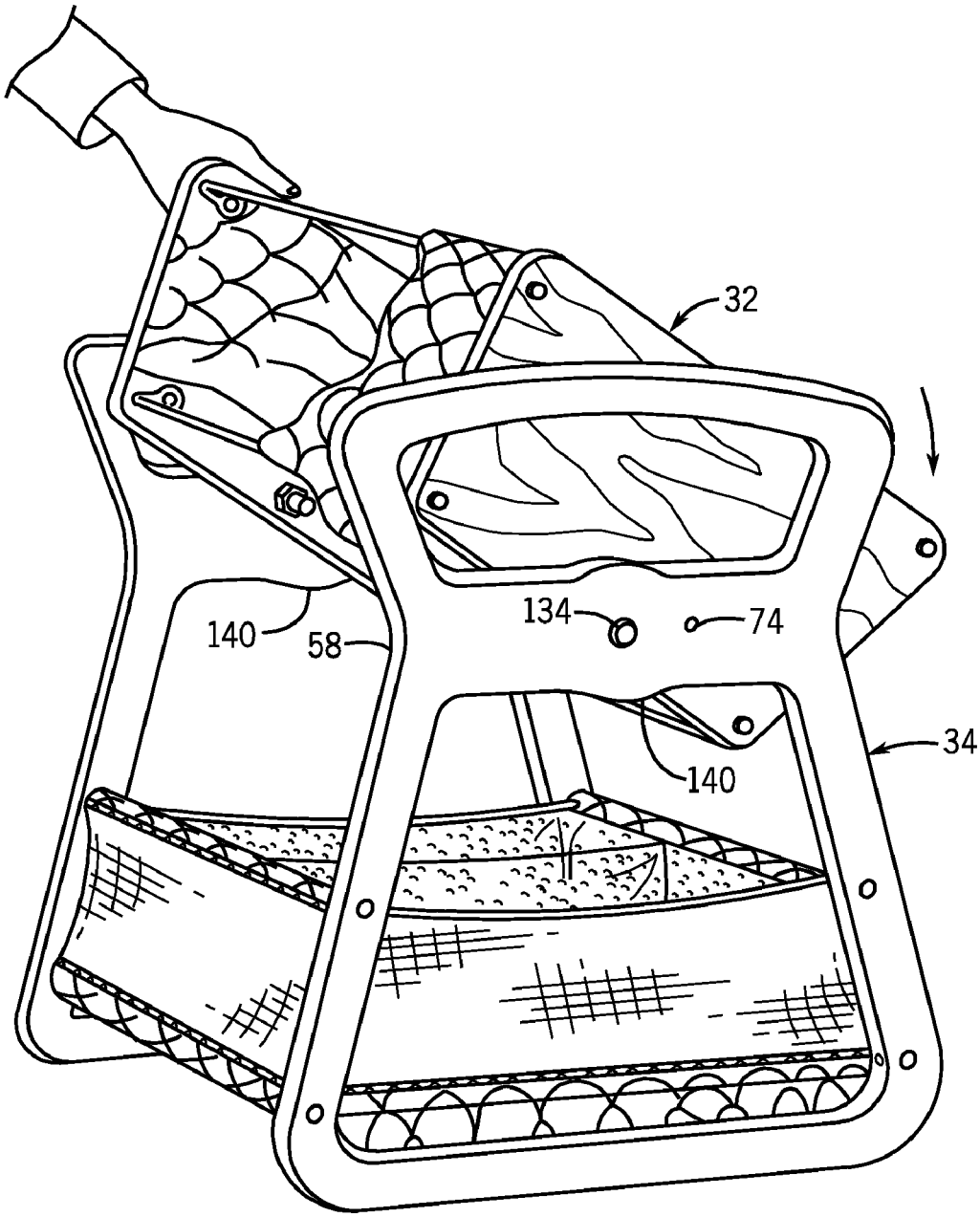
FIG. 4 is an end side, perspective view of the bassinet of FIG. 1 during an adjustment between the first stage orientation and a second stage orientation.
Figure 6:
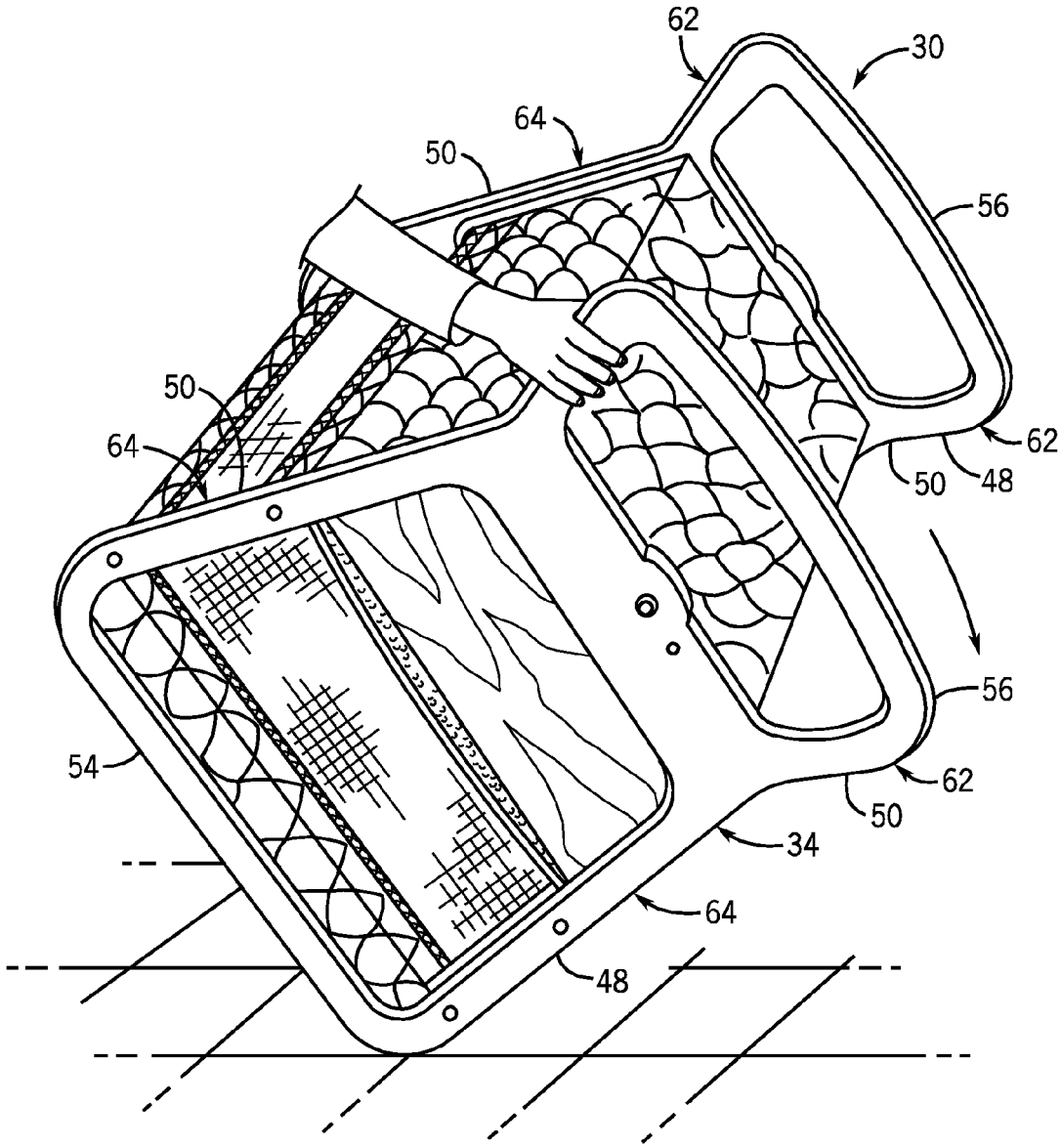
FIG. 6 is a perspective view of the bassinet of FIG. 1 as the frame is flipped during the adjustment between the first and second stage orientations.
Figure 7:
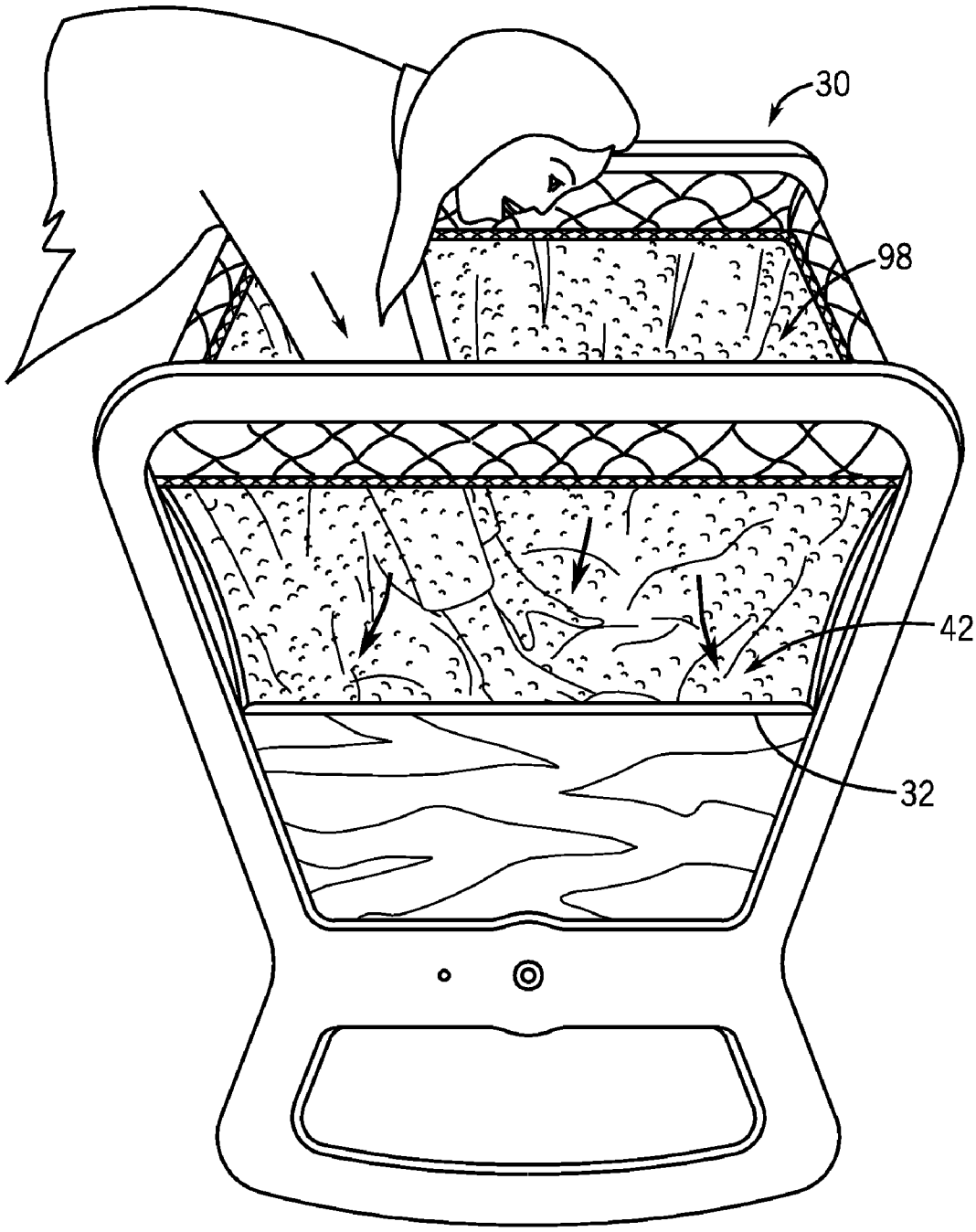
FIGS. 7 and 8 are further end, perspective views of the bassinet of FIG. 1 after the frame has been flipped to revert the bed basket to an upright position and while soft goods are repositioned or replaced to create the deeper sleep space of the second stage orientation.
Figure 8:
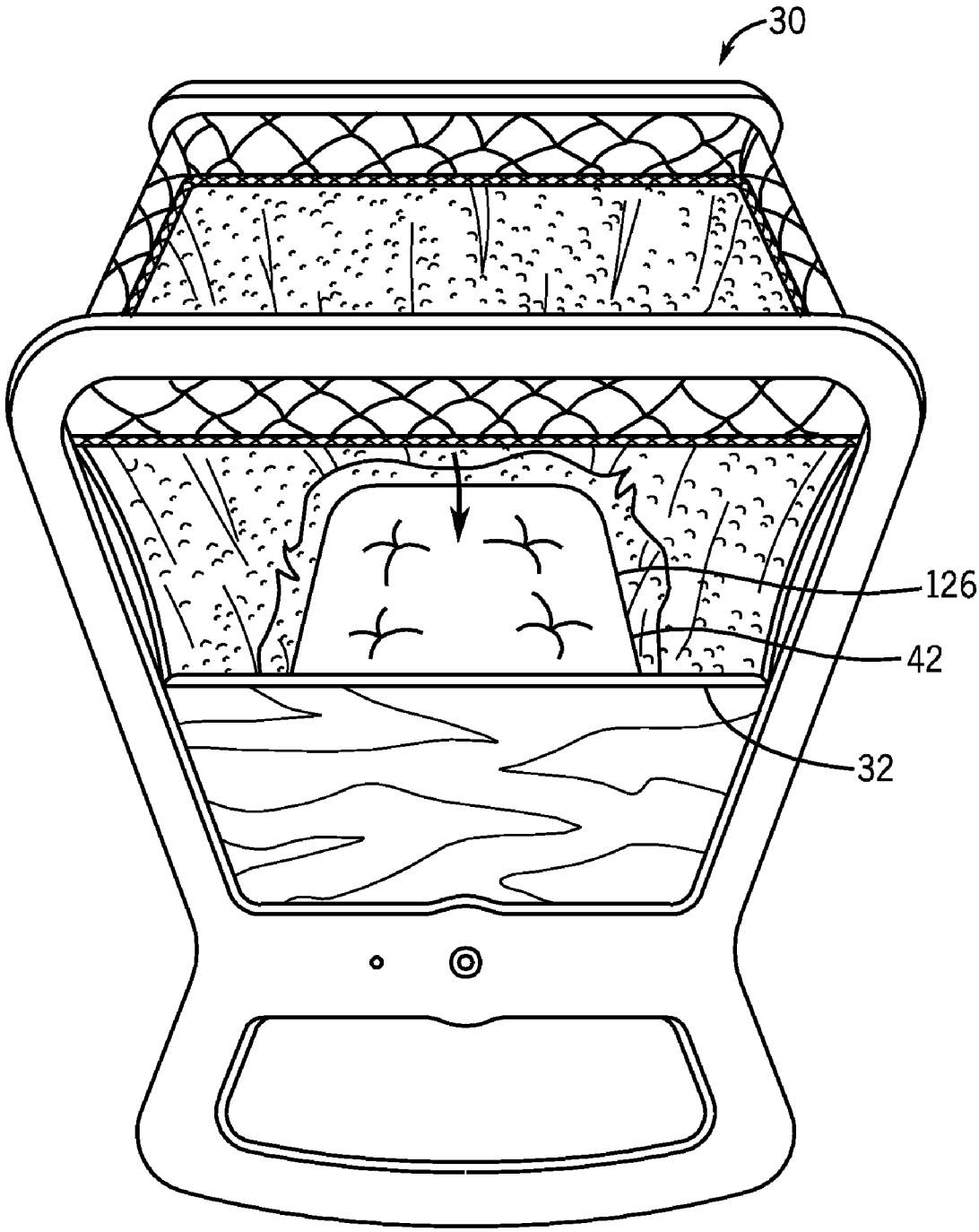

FIGS. 4-7 illustrate the steps taken during the conversion, or reorientation, of the bassinet 30 from the first stage configuration of FIG. 1 to the second stage configuration, which is shown in FIG. 8. The conversion is generally based upon a rotatable frame assembly. The conversion may also include a soft goods adjustment or reconfiguration once the frame assembly is in position. For example, as a preliminary step, the mattress pad 126 (FIG. 3) may be removed from the bed basket 32 before the frame rotation steps occur. The frame-related aspects of the conversion generally involve two steps which may be performed in any order or simultaneously. As shown in FIG. 4, one step involves rotating the bed basket 32 relative to the frame 34. That step begins with a disengagement of the bed basket 32 and the frame 34 via removal of the fastener 72 (FIG. 2) from the hole 74. The bed basket 32 rotates about the pivot axis defined by the bolts 134 mounted in the neck section 58, which may have a center area shaped as a hub 140 to highlight the rotation and the pivot axis.

Figure 5:
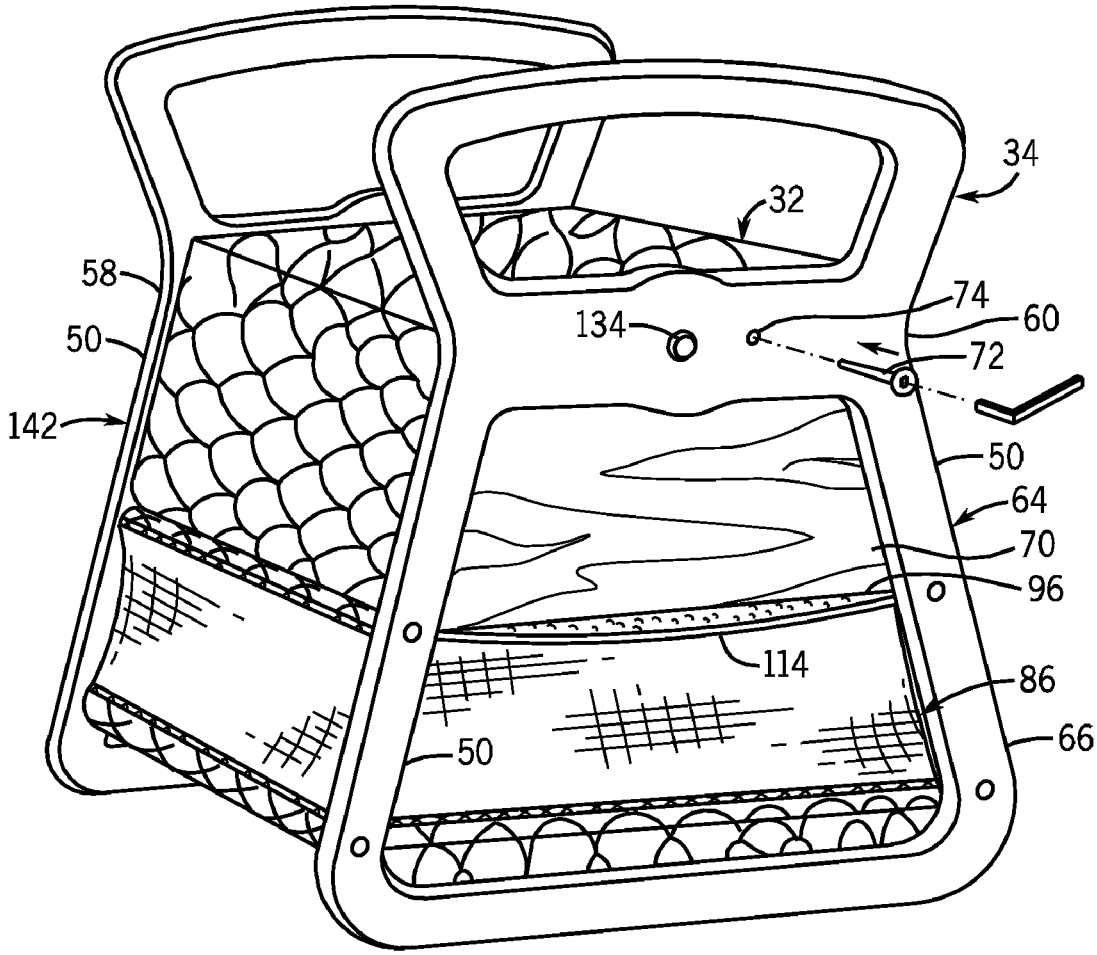
FIG. 5 is another end side, perspective view of the bassinet of FIG. 1 showing a basket bed in an inverted position during the adjustment between the first and second stage orientations.

Once the bed basket 32 is flipped or inverted 180 degrees to the bottom-up position shown in FIG. 5, the fastener 72 is reinserted in the hole 74 to lock the bed basket 32 in place. To that end, the fastener 72 engages another hole (not shown) in the end panel 70 located opposite the hole through which the fastener 72 passes in the stage one configuration. The two holes in the end panel 70 are spaced equidistant from the pivot axis hole.

The intermediate state of the conversion shown in FIG. 5 also depicts a bed basket receiving region 142 made available between the long support sections 64 of the stands 48. The region 142 lies below the neck section 58 (or the cross beam 60) and above the storage basket 86. The storage basket rim 96 lies low enough to allow the bed basket 32 to rotate into the region 142 and assume the inverted position shown. In order for the bed basket 32 to clear the rim 96 during rotation, the radial distance or height of the bed basket 32 does not exceed the distance between the rod 108 and the pivot axis. On the other hand, the storage basket 86 is configured in positioned such that the rim 96 of the storage basket 86 is in close proximity to the top rim of the bed basket 32. As a result, the edges of the side walls and the end walls (or panels) of the two baskets are also in close proximity. Along the end walls, the welting 114 is shown with a slight downward sag for ease in illustration of the interior soft goods (e.g., mesh) of the storage basket 86.

Once the bed basket 32 is inverted, the walls or panels of the two baskets are also aligned. Along the side walls, the exterior mesh of the storage basket is aligned with the quilt layer of the bed basket. Along the end walls, the exterior mesh of the storage basket is aligned with the end panel 70. As a result of this alignment, the exterior portions of the storage basket 86 form an extension of the bed basket 32. In this example, the extension is oriented at the same angle with respect to vertical, because the side panels and the long support section 64 and the linear segments 66 of the uprights 50 are inclined at the same angle.

FIG. 6 depicts the other frame rotation step. In this example, the entire frame 34 is flipped or inverted to reach the stage two orientation or configuration. To that end, the caregiver lifts the frame 34 off the rest surface so it no longer rests upon the cross beams 54. The caregiver then rotates the frame 34 until it rests upon the cross beams 56, which now act as the bases or foundations of the bassinet 30. In this example, the cross beam 56 is arched to act as a rocker. More generally, as a result of this step, the stands 48 are rotated to an orientation 180 degrees from the orientation shown in FIGS. 1-3, such that the long support section 64 of each upright 50 is now disposed above the short support section 62 thereof.

FIG. 7 shows the bassinet 30 after both frame rotation steps have been completed. The combination of both steps results in an upward facing orientation of the bed basket 32. That is, the frame rotation shown in FIG. 6 reverses the bottom-up orientation of the bed basket 32 shown in FIG. 5. In contrast, the soft goods of the storage basket 86 (FIGS. 1-5) are now disposed in a bottom-up orientation. More specifically, the interior mesh layer 98 of the storage basket 86 is falling down toward the space within the bed basket 32. Instead of looping or passing over the rods 108 (FIG. 3) to form the storage basket 86 as shown in FIG. 3, the frame rotation causes the interior mesh layer 98 to extend past the rods 108 toward the bed basket 32. The interior mesh layer 98 may thus be pushed downward into the space within the bed basket 32 until forming taut or smooth sides. A caregiver is shown in FIG. 7 pushing the interior mesh layer 98 downward to flatten it against the bottom 42 of the bed basket 32. To this end, the interior mesh layer 98 may be configured and sized to match the dimensions of the bed basket 32. In that case, the divider 88 (FIGS. 1 and 2) of the storage basket soft goods is folded down or flat to complete the formation of the stage two bed basket space.

As shown in FIG. 8, to complete the conversion, the mattress pad 126 is reinserted and placed into the bed basket space on top of any soft goods of the storage basket 86 (FIGS. 1-5) flattened against the bottom 42 of the bed basket 32. The soft good layers associated with the storage basket 86 now contribute to the wall structure of the bassinet 30 to achieve a stage two configuration. With the added height of the storage basket soft good layers, the wall height may be increased from about 8 inches to, for example, about 20 inches.

The rotation of the bed basket 32 need not rely a pivot assembly or other rotatable coupling with the frame 34. In alternative cases, the bed basket 32 may be disengaged from the frame 34, inverted to the orientation shown in FIG. 5, and re-engaged with the frame 34. Despite the lack of connection during the inversion step, the inversion of the bed basket still involves rotation of the bed basket. However, incorporation of the rotational coupling arrangements described herein may provide assistance during assembly.

Figure 9B:
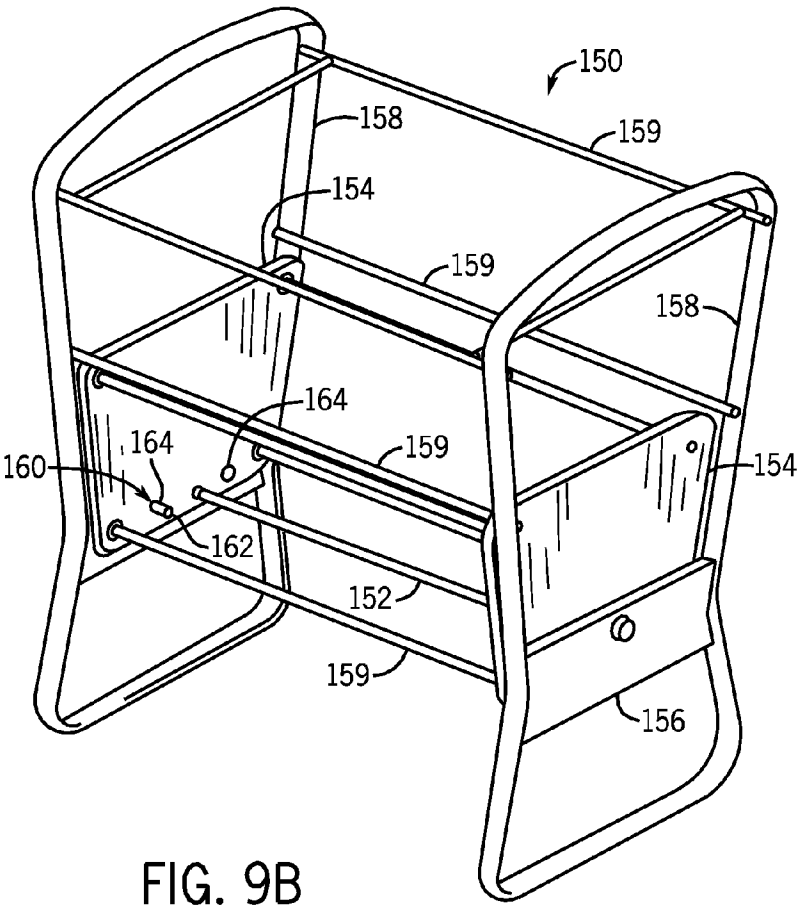
FIGS. 9A and 9B are perspective views of an alternative frame for use in connection with the bassinet of FIG. 1 in accordance with one embodiment.
Figure 9A:
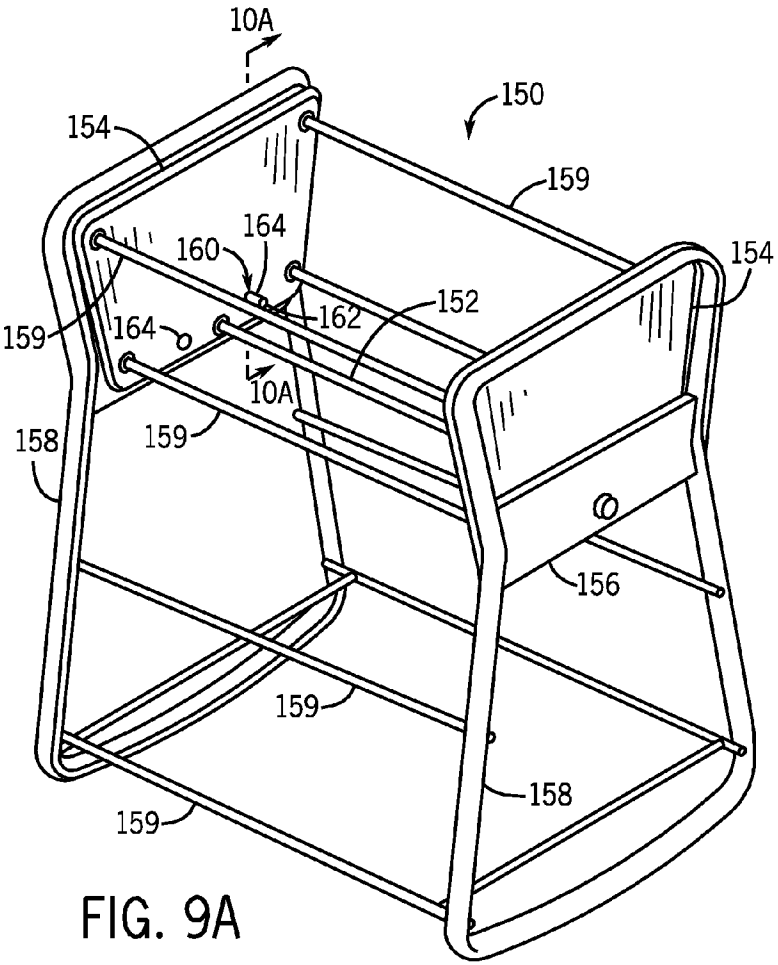

Turning now to FIGS. 9A and 9B, an alternative frame assembly 150 has a swivel shaft or rod 152 to support the above-described rotational conversion. Instead of a pair of bolts for each end panel, a swivel shaft or axle 150 is coupled to both end panels 154 and mounted to pivot plates or cross bars 156 at each leg stand 158. As a result, the swivel shaft 150 extends the lateral width of the frame assembly 150 and may provide structural support to a mattress or other platform (not shown) that forms the bottom or bed of the bed basket. The swivel shaft 152 may be accompanied by any number of other components (e.g., nuts, spacers, etc.) to complete a rotator assembly at each end panel 154 and each mounting plate or bar 156.

The frame assembly 150 differs in several other ways from the above-described embodiment. The leg stands 158 may be formed of materials other than wood, such as metal or plastic. Nonetheless, some of the sections of the leg stands 158 may, but need not, be shaped as slats. The frame assembly 150 includes a number of support tubes 159 that may be made of a variety of materials in contrast to the, for instance, wire form or other rod-based construction of the example described above. The tubes 159 may be secured in place in a variety of ways, including via, for instance, threaded tips or ends that engage a fastener disposed in or on the end panels 154 or the leg stands 158.

The frame assembly 150 also has an alternative lock-and-release mechanism 160 for securing the frame assembly 150 in either the stage one orientation or the stage two orientation. The mechanism 160 replaces the fastener-based approach described above, but may be disposed in a similar location. Instead of a screw fastener, the mechanism 160 includes a spring-loaded pin or plunger 162 that fires into one of two holes 164 in one of the end panels 154.

Figure 10B:
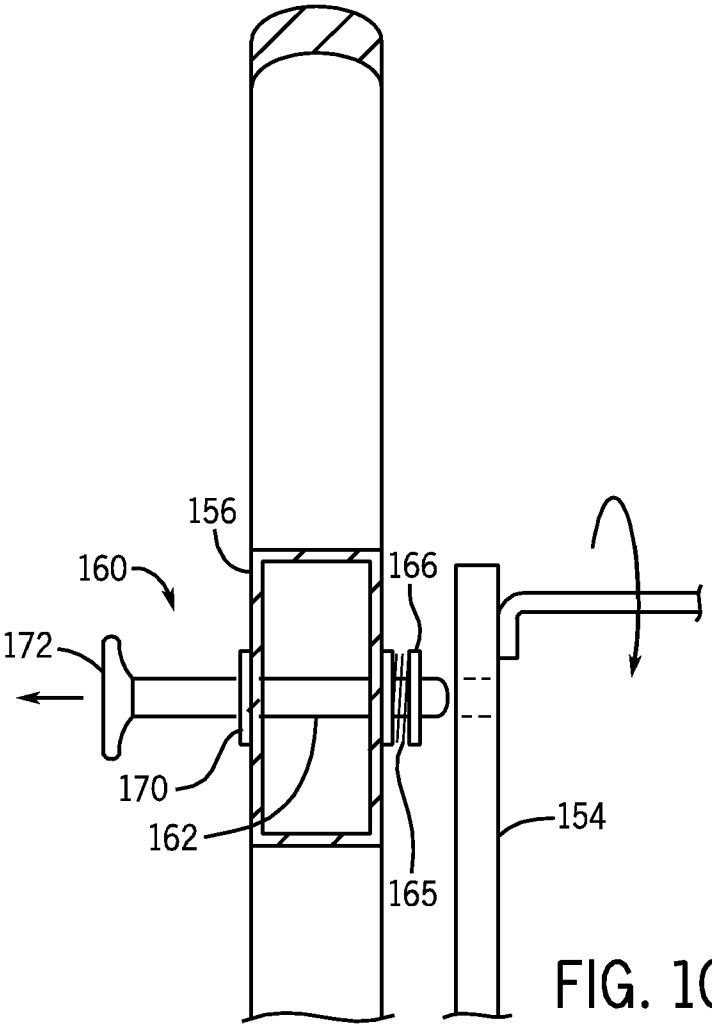
FIGS. 10A and 10B are sectional views of a lock-and-release mechanism for use in connection with the bassinet of FIG. 1 in accordance with one embodiment taken along lines 10-10 of FIG. 9A.
Figure 10A:
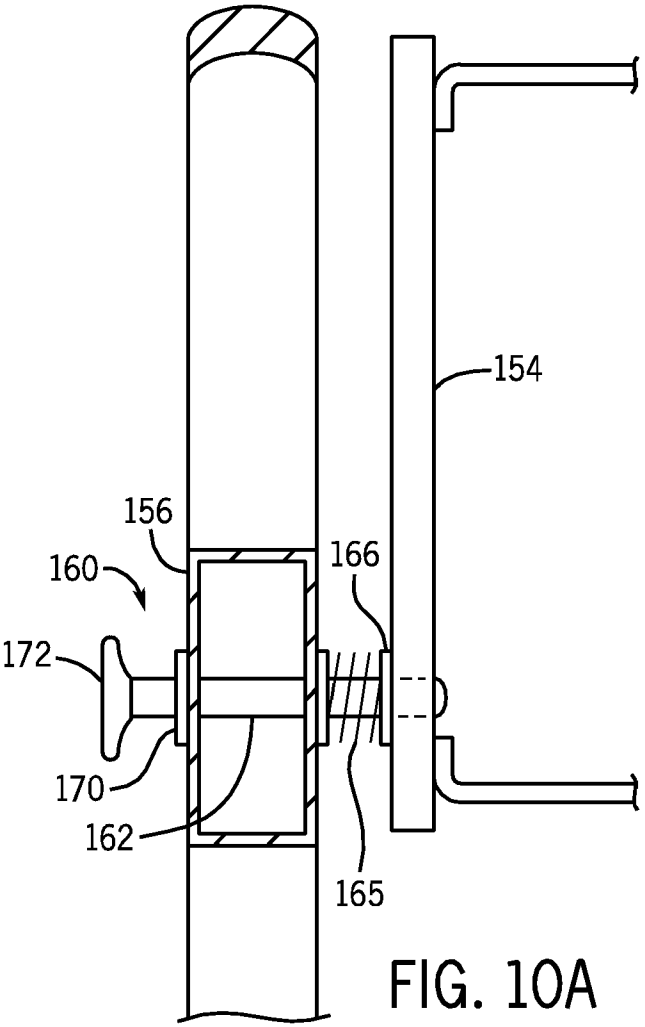

FIGS. 10A and 10B show the lock-and-release mechanism 160 of the frame assembly 150 in greater detail. The pin 162 passes through the mounting plate 156 to reach the end panel 154. A spring 165 carried by the pin 162 is disposed between the plate 156 and a flange 166 to bias the pin 162 toward the end panel 154 and, thus, the engaged or locked position shown in FIG. 10A. A caregiver pulls on a handle or head 168 of the pin 162 to compress the spring 164 against the mounting plate 156 (or a stationary washer adjacent thereto) and retract the pin 162 from the end panel 154 as shown in FIG. 10B, thereby allowing the end panel 154 to rotate. Another flange 170 may be carried on the pin 162 or the plate 156 to limit travel of the pin 162 once a head 172 of the pin 162 is released by the caregiver.

Figure 11A:
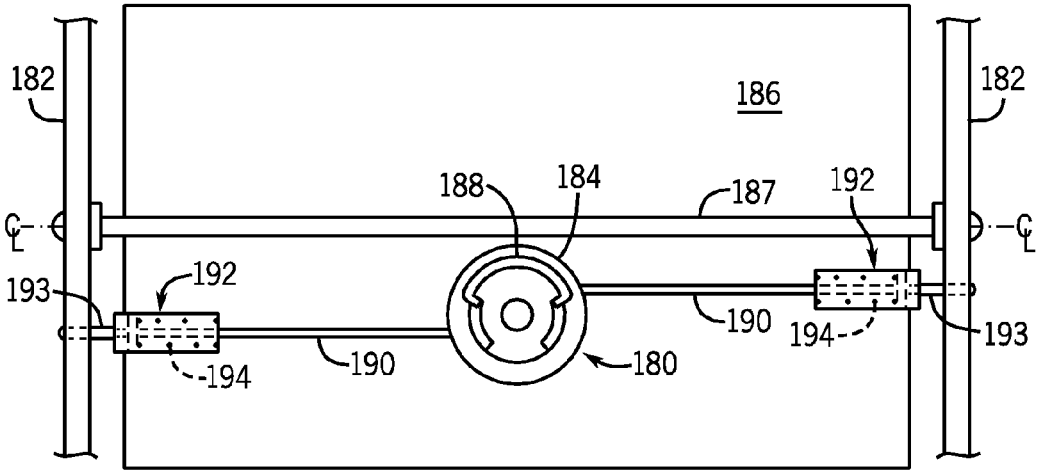
FIGS. 11A and 11B are plan views of a lock-and-release mechanism for use in connection with the bassinet of FIG. 1 in accordance with another embodiment.
Figure 11B:
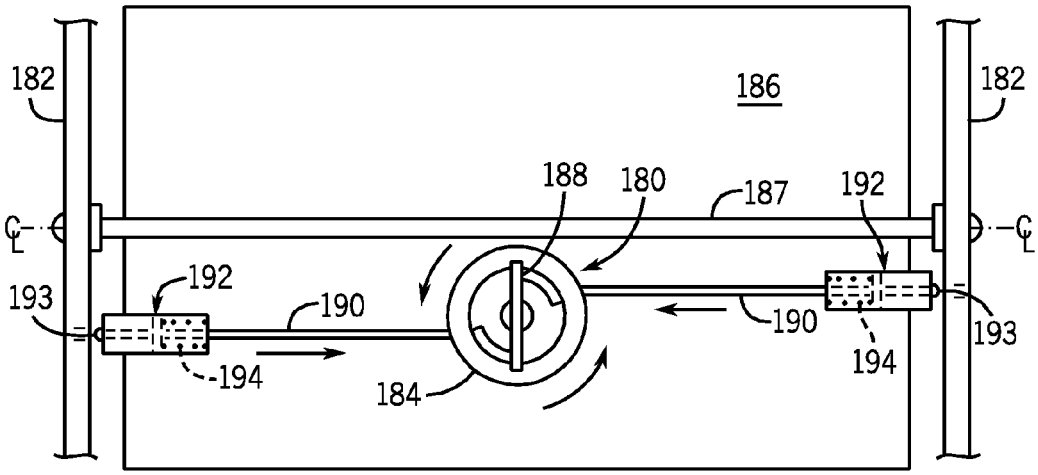

With reference now to FIGS. 11A and 11B, another lock-and-release mechanism 180 utilizes a pair of spring-loaded pins to engage a pair of opposed end panels 182. In this example, a hub 184 is rotatably mounted or otherwise disposed on or along a panel or platform 186 between the end panels 182. The panel 186 may be, in turn, disposed adjacent a pivot shaft 187. The panel 186 may form a bottom of the bed basket. The hub 184 has a hinged handle 188 that can flip upright for a caregiver to grasp to rotate the hub 184. As it rotates, the hub 184 pulls a pair of cables 190 in opposite tangential directions. Each cable 190 terminates in a pin assembly 192 having a pin 193 that is pulled inward as shown in FIG. 11B, thereby disengaging from the respective end panel 182. A return spring 194 within each pin assembly 192 is configured to bias the pin assembly 192 toward the engaged positions shown in FIG. 11A once the handle 188 is released by the caregiver.

FIGS. 12A and 12B show an alternative bassinet 200 having a frame 202 constructed in accordance with several aspects of the disclosure. In this example, the frame 202 includes a short support section 204 with a cross beam 206 having an arcuate shape to act as a rocker rail. The cross beam 206 provides a base or foundation for the bassinet 200 during use in the second stage orientation, as described above. As shown in FIG. 12B, the cross beam 206 has a pair of feet 208 that can be extended laterally to widen the foundation of the bassinet 200 in the second stage orientation. The feet 208 may slide on tracks (not shown) or be otherwise slidably engaged with the cross beam 206 so that they can be retracted to the storage positions shown in FIG. 12A. In some cases, each foot 208 may have an arcuate shape that matches the shape of the cross beam 206. In this way, the bassinet 200 can still be used as a rocker in the second stage orientation when the feet 208 are deployed as shown in FIG. 12B.

Alternatively or additionally, any of the bassinets described herein may be equipped with feet or other base structures to prevent rocking while providing a wider foundation for stability. For example, the feet may slide along the cross beam or rail from a storage position outward to a deployed position. Alternatively, the feet may clip or otherwise attach to the cross-brace or rail when additional stability is desired.

Figure 13B:
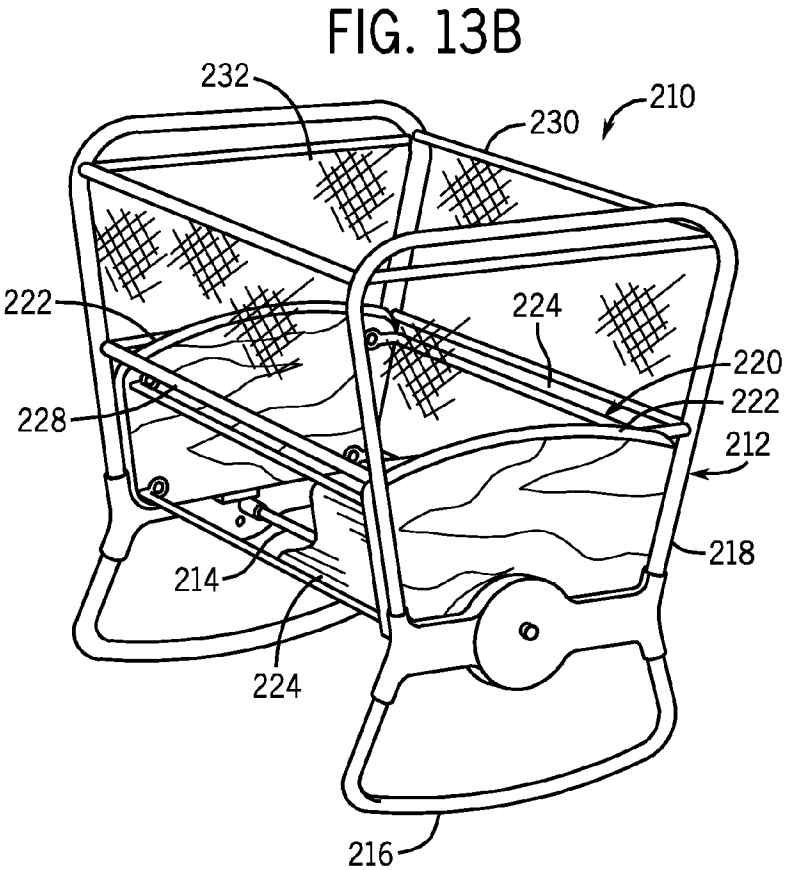
FIGS. 13A and 13B are perspective views of a bassinet frame constructed in accordance with an alternative embodiment in which an axle or shaft enables rotational adjustment between first and second stage orientations.
Figure 13A:
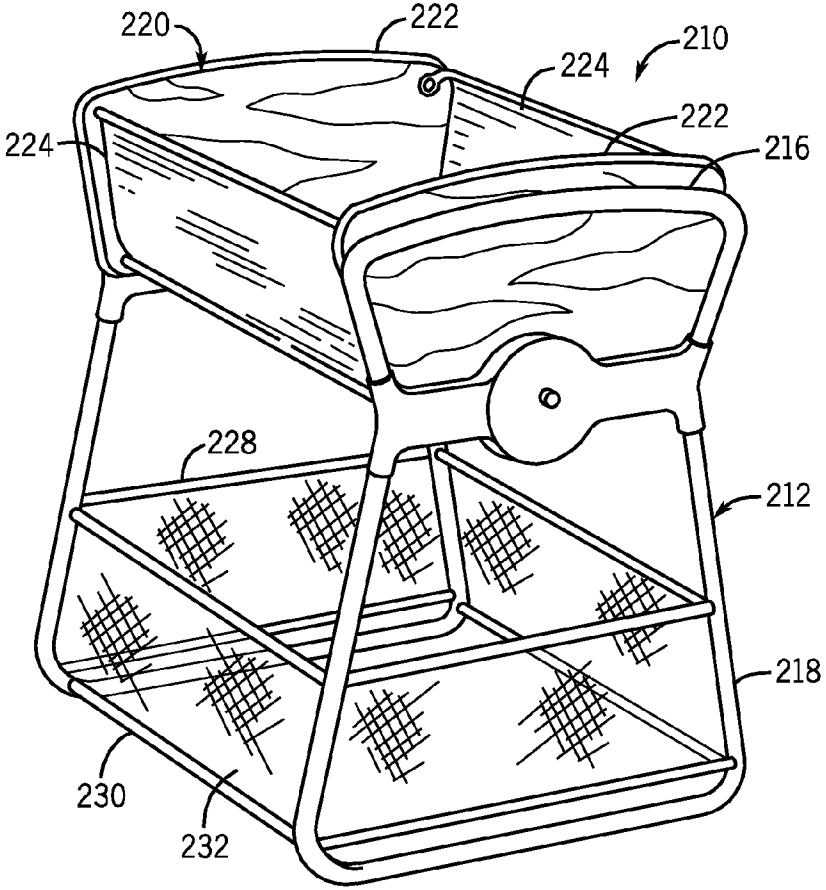

FIGS. 13A and 13B show an alternative bassinet 210 with a frame assembly 212 composed primarily of tubular frame components, including a rotation shaft 214 (FIG. 13B) that runs the width of the bassinet 210. In some cases, each tubular component includes a metal frame tube. Shorter cross braces or rails 216 of leg stands 218 are curved to form second stage rockers. In this example, a bed basket 220 has a wall structure defined by end walls or panels 222 and side walls 224. In contrast to the embodiments described above, the side walls 224 may include a rigid or semi-rigid panel in addition to soft goods. For example, each side wall 224 may be composed of a molded plastic plate shaped as desired. Despite the use of hard goods, each side wall 224 may be supported via one or more rods, wire form structures, or other structures that extend laterally between the end walls 222. A perimeter of a storage basket 226 may be defined by first and second sets of rods 228, 230 that support a screen 232 extending therebetween. The rod sets 228, 230 and the screen 232 may provide structural support for soft goods (not shown) used in both the stage one orientation (FIG. 13A) and stage two orientation (FIG. 13B).

Figure 14B:
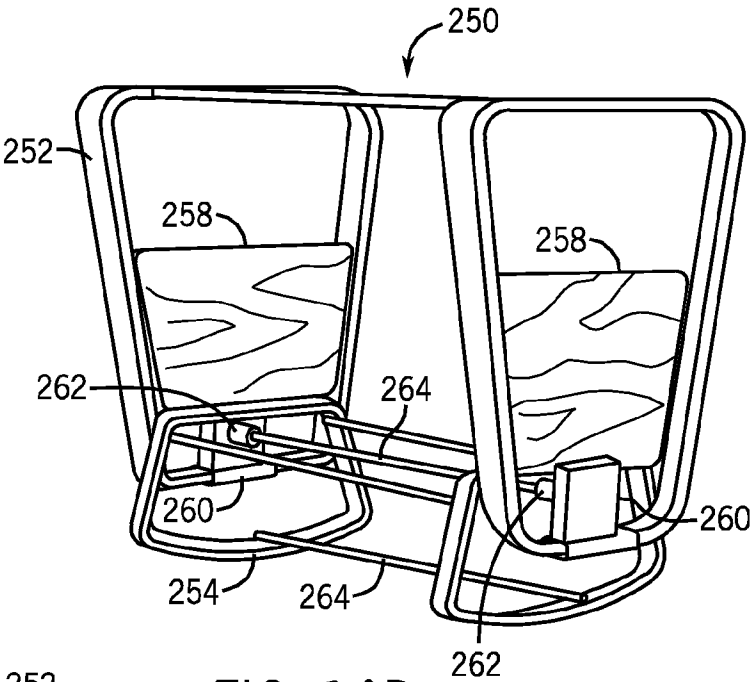
FIGS. 14A and 14B are perspective views of a bassinet frame constructed in accordance with yet another alternative embodiment in which an axle or shaft enables rotational adjustment between first and second stage orientations.
Figure 14A:
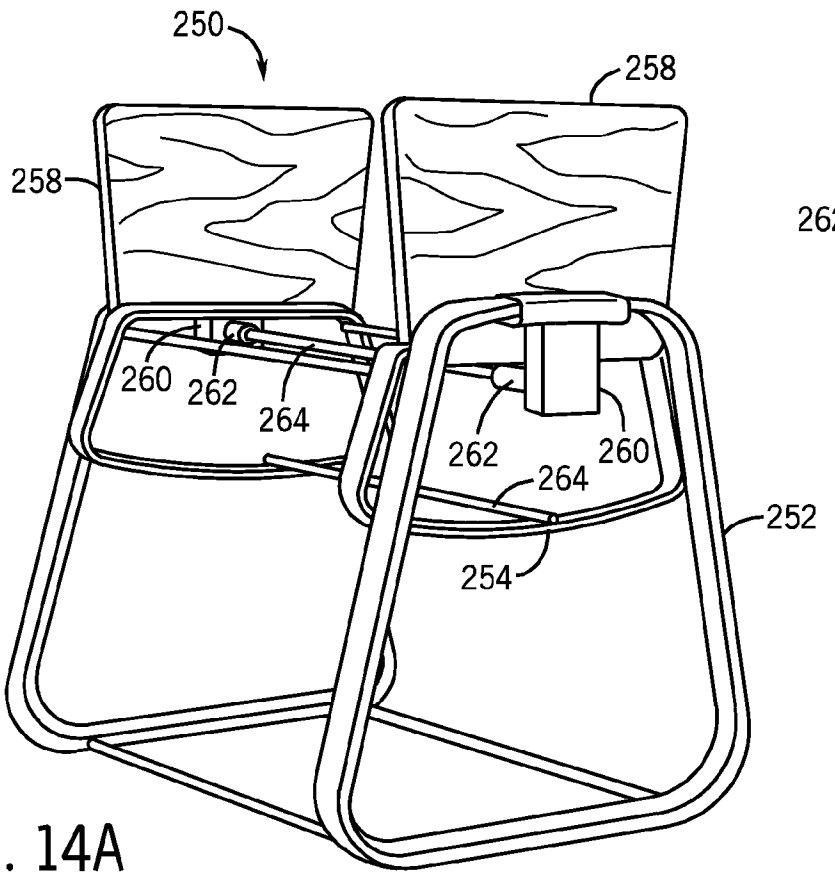

FIGS. 14A and 14B show a bassinet 250 with an alternative frame assembly having two separate or discrete leg stands 252, 254 at each end of the bassinet 250 for use in the stage one and stage two orientations, respectively. The stands 252 is pivotably coupled to a bed basket 256 defined by end panels 258 via a pivot mount 260. The stands 254 are fixedly coupled to the bed basket 256 to rotate therewith during conversion, and act as risers to elevate the sleeping surface during use in the stage two orientation as shown in FIG. 14B. In this example, the pivot mounts 260 may include a bushing 262 in which a rotator shaft 264 is captured. A lateral stabilizer bar 264 connects the stands 254 for added rigidity when the stands 254 serves as the base or foundation of the bassinet 250.

Figure 15:
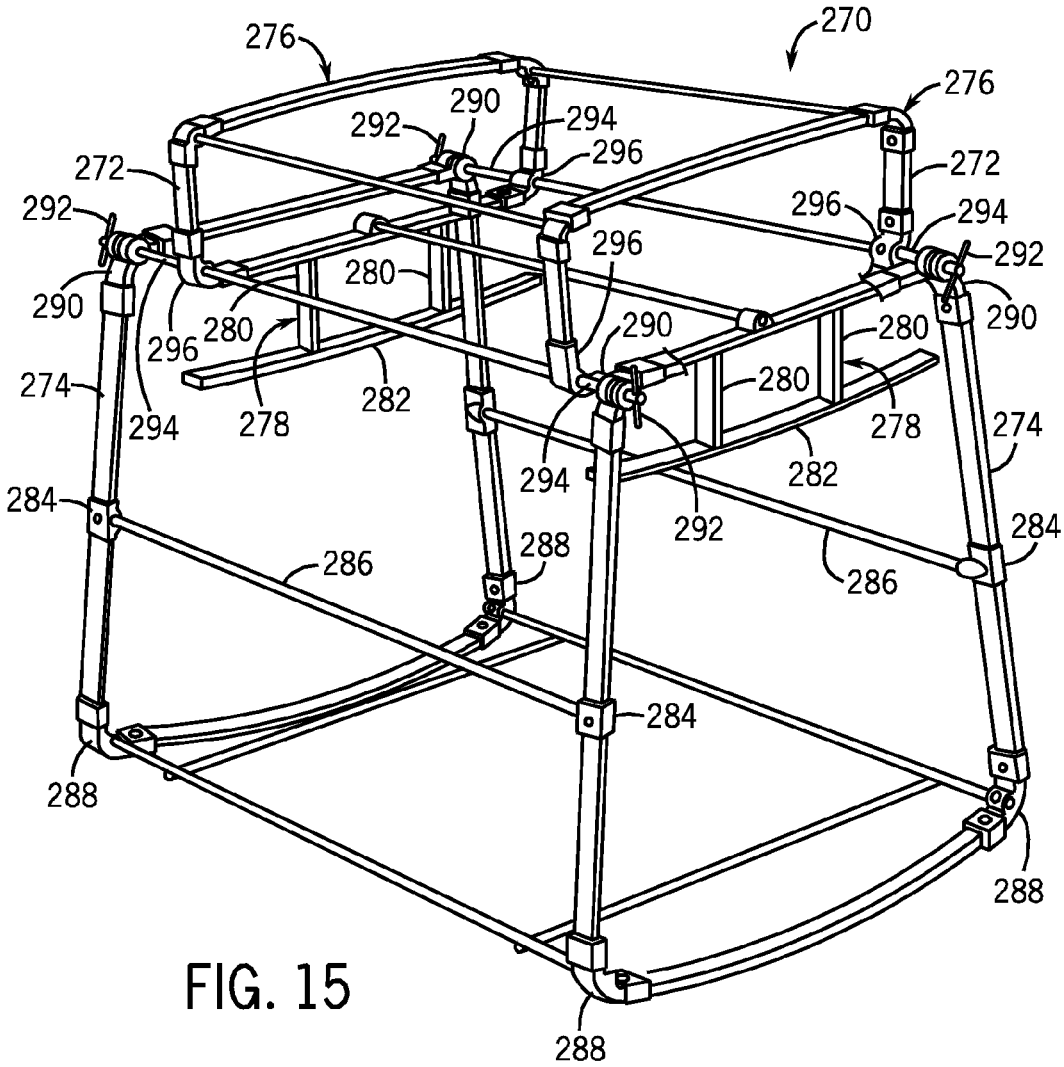
FIG. 15 is a perspective views of a bassinet frame constructed in accordance with yet another alternative embodiment in which an axle or shaft enables rotational adjustment between first and second stage orientations.

FIG. 15 depicts another alternative frame assembly 270 that also includes discrete or separate leg stands 272, 274 at each end of the assembly. In this example, each leg stand 272 includes a bed frame section 276 and a riser section 278. The bed frame section 276 is directed to providing structural support for the hard and soft goods of the bed basket, while the riser section 278 includes a pair of legs 280 and a rocker base 282 to support the bed frame section 276 at a desired height during stage two operation. The rocker base 282 may also be use to support a platform that can act as a shelf during orientation in the stage one configuration.

The frame assembly 270 differs from the examples described above in its use of a number of frame joints. For example, frame joints 284 are configured to capture and position lateral rods or tubes 286 for extension from the leg stands 272. Corner frame joints 288, 290 may configured to assemble the tubing or other components of the leg stands 272 themselves. The corner frame joints 290 may also be configured with a T-shaped handle 292 that allows a caregiver to pull a spring-loaded plunger 294 to release and disengage the leg stands 272, 274 from one another. Each plunger 294 includes a pin embedded in a joint 296. In this way, some of the joints are used to lock and release the frames, thereby permitting the conversion between orientations.

Figure 16:
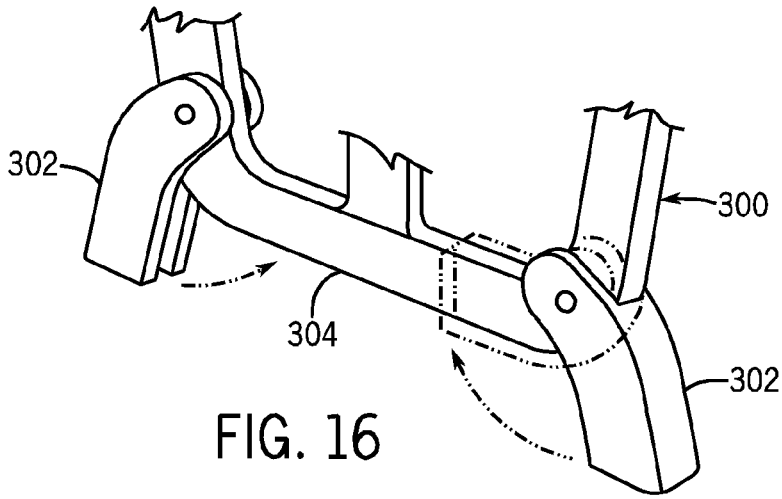
FIG. 16 is a partial, perspective view of a bassinet frame having adjustable feet to reconfigure a base for use in either a first stage orientation or a second stage orientation.

FIG. 16 shows an example of a bassinet base 300 with feet or stabilizers 302 that also act as risers to elevate the bassinet. The feet 302 are pivotably coupled to the base 300 for rotation as shown. In this way, the bassinet may alternately rests on the feet 302 or on cross beams or rails 304 as desired. The rails 304 may be arcuate shaped as described above to allow for operation as a rocker. In those cases, the feet 302 may also provide an anti-rocker feature. The feet 302 may be incorporated into the frames of any of the above-described embodiments. The stabilizing nature of the feet may be helpful in situations where a broader base is desired.

In other examples, the disclosed bassinets convert between orientations or configurations via rotation adjustments other than flips, yet still manage to change from a typical bassinet size and geometry to a "non-full size crib" size and geometry that presents a deeper sleeping space with higher side walls.

Figure 17A:
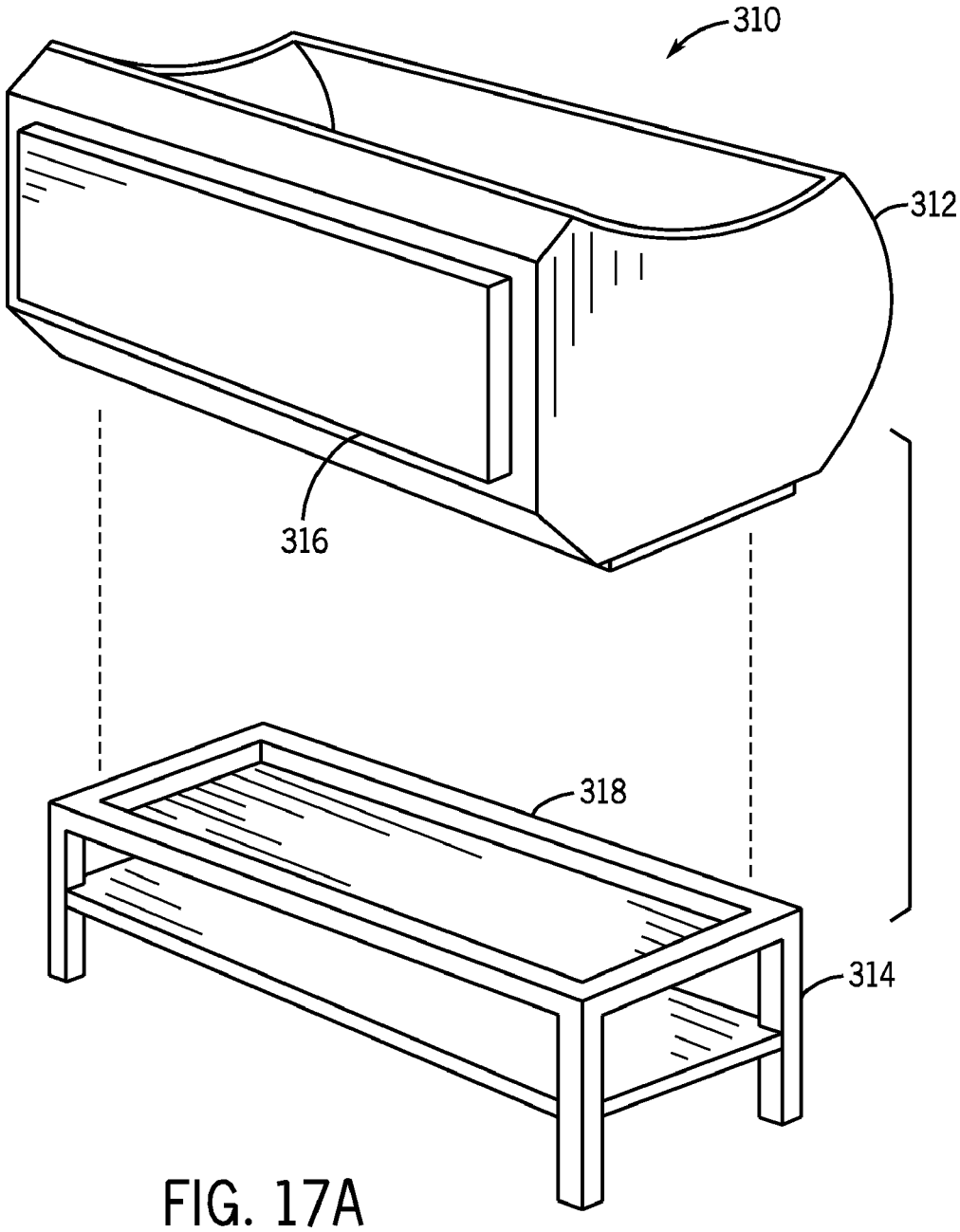
FIGS. 17A-17C are perspective views of another exemplary bassinet configured for wall height adjustment via frame rotation and constructed in accordance with several aspects of the disclosure.
Figure 17B:
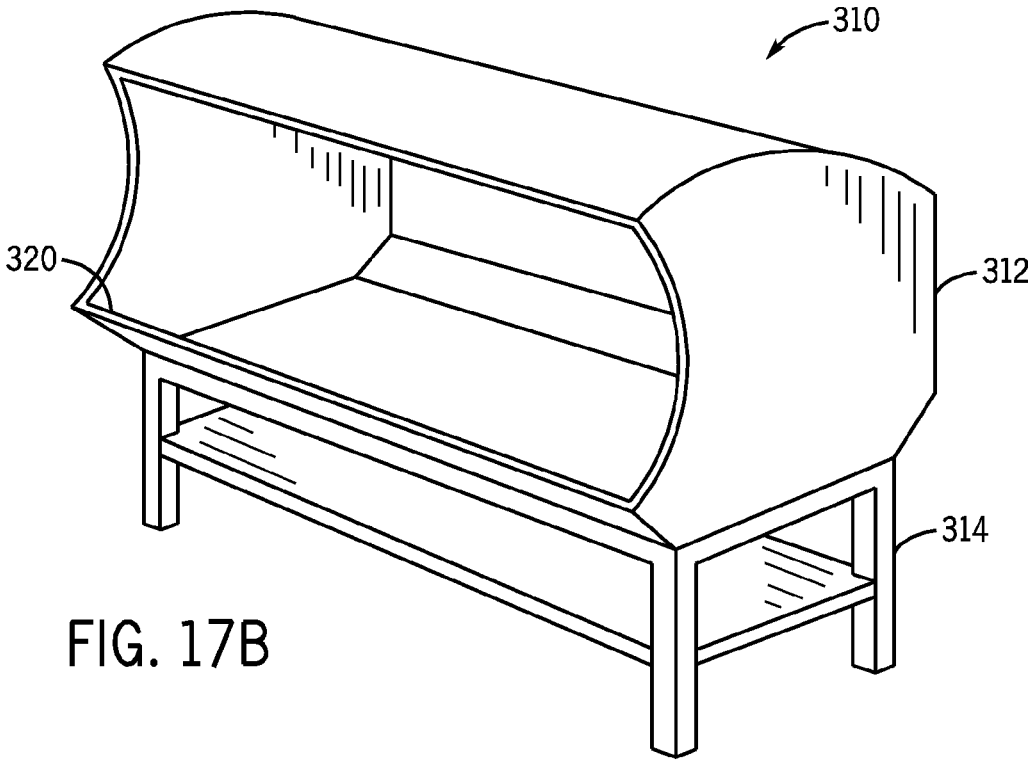
Figure 17C:
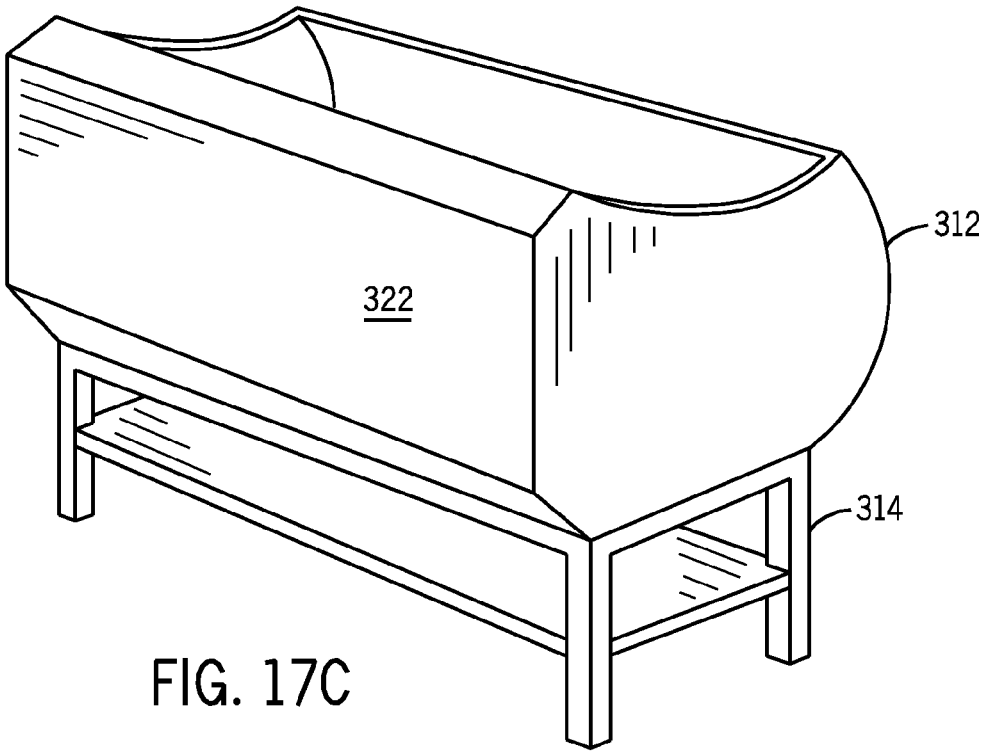

FIGS. 17A-17C show another example of a rotatable bassinet 310 constructed in accordance with the teachings of the present invention. In this example, the bassinet 310 is adjusted between stage one and stage two orientations via placement of a bed basket 312 on a base 314 in at least two different configurations or positions. The bed basket 312 has at least two flat lengthwise panels 316 that project outward to engage a matching depression or receptacle 318 in the base 314. The first stage position is shown in FIG. 17B, in which an opening in the bed basket 312 is oriented to face laterally outward. A lip 320 that defines the height of the wall structure presented at the opening. The second stage position is shown in FIG. 17C, and is reached via a 90 degree rotation of the bed basket 312 from the first stage position. The bed basket 312 rests on another of the panels 316 that orients the opening upward to increase the wall height to correspond with the height of a side wall 322 of the bed basket 312.

Figure 18A:
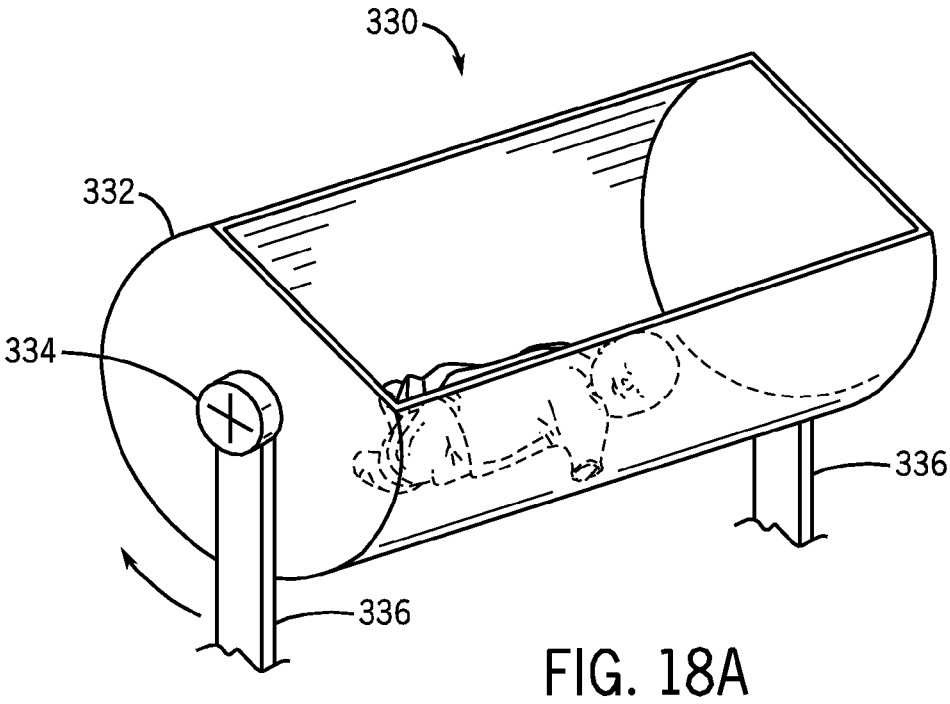
FIGS. 18A and 18B are perspective views of yet another exemplary bassinet configured for wall height adjustment via frame rotation and constructed in accordance with several aspects of the disclosure.
Figure 18B:
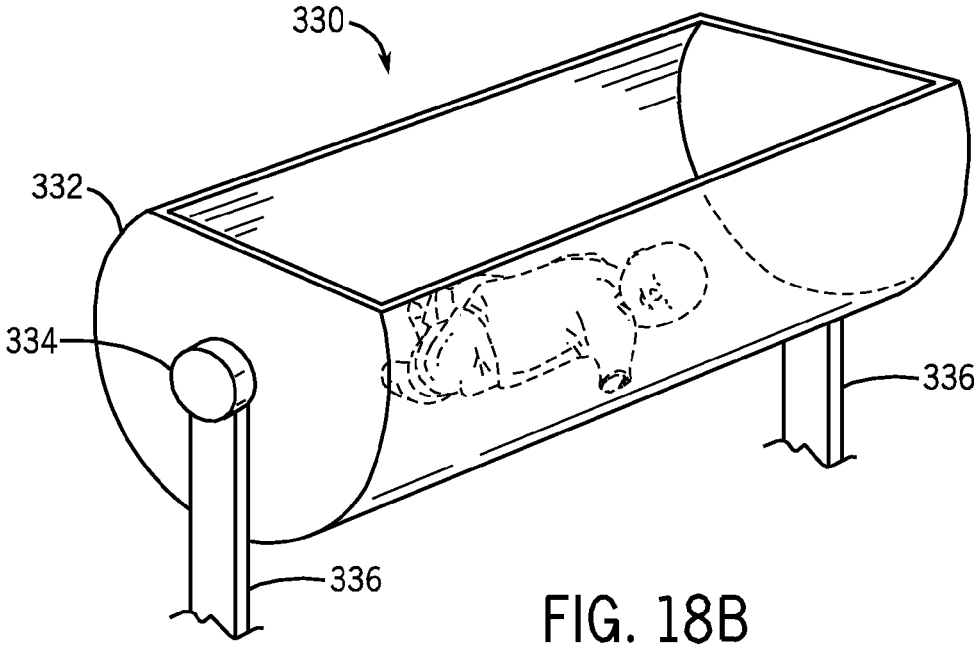

FIGS. 18A and 18B show another example of a bassinet 330 with a height adjustable wall structure via a bed basket 332 that rotates about a pair of hubs 334 supported above a rest surface by stands 336. The hubs 334 are disposed at ends of two upstanding posts of the stands 336 that may connect to a base (not shown) that rests on a floor surface. Conversion between the first stage and second stage orientations (or any orientation therebetween) involves rotating the bed basket 332 about the rotation axis defined by the hubs 334. In this example, the bed basket 330 is substantially cylindrical and includes an opening for access to an interior sleeping area. The sleeping area has a surface that is substantially at a bottom of the bed basket 330. The sleeping surface may be stationary and independent of the rotational position or orientation of the bed basket 332. The opening has axial edges along the length of the cylinder that adjustably define the height of the walls. In the first stage position (FIG. 18A), the axial edges are offset in elevation, defining an angled opening with an upper edge and a lower edge. The spacing between the surface of the sleeping area and the lower edge determines the lowest adjustable wall height. In this example, the lower wall height in the first stage position may be 8-12 inches. FIG. 18B shows the bed basket 332 in the second stage position in which the axial edges may be at substantially the same elevation with the opening facing up.

Figure 19A:
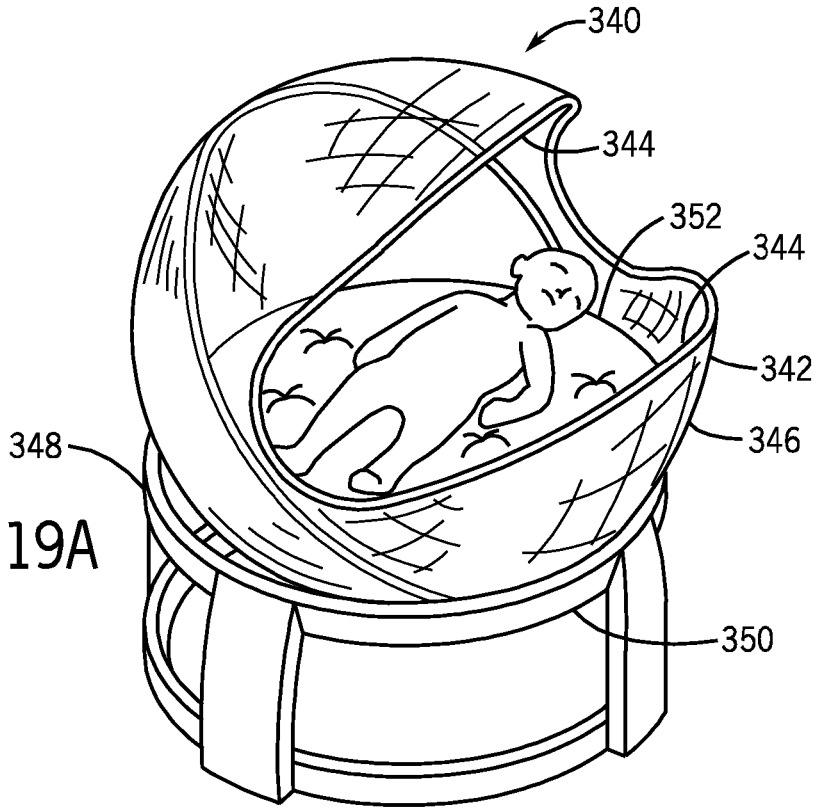
FIGS. 19A and 19B are perspective views of still another exemplary bassinet configured for wall height adjustment via frame rotation and constructed in accordance with several aspects of the disclosure.
Figure 19B:
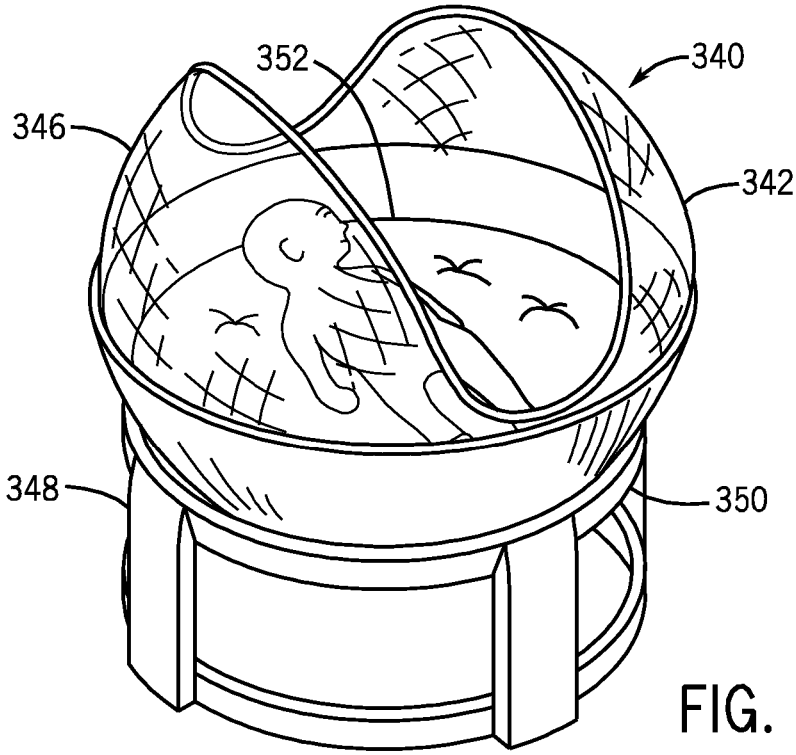

FIGS. 19A and 19B show another example of a rotatable bassinet 340. In this case, the bassinet 330 has a substantially spherical bed basket 342. The bassinet 340 is adjusted between a first stage position (FIG. 19A) and a second stage position (FIG. 19B) via changes to the elevation of an opening having arcuate edges 344. However, the spherical nature of this example allows the bed basket 342 to be positioned in any number of rotational orientations, including but not limited to a first stage position with a low side wall height of 8 inches, an intermediate stage position with a low side wall height of 12 inches, and a second stage position with a 20 inch wall height on either side of the opening.

In this example, the spherical bed basket 342 has a shell 346 that rests on a frame 348, which may include a stand or base for a support ring 350. The stand of the frame 348 may include a number of upstanding posts as shown. Because the bed basket 342 is spherical, its outer surface is engaged by the support ring 350 regardless of its rotational position. In some cases, the bed basket 342 includes a rigid shell portion and a screen portion as shown.

As with each of the disclosed bassinets, the bassinet 340 may also include a locking mechanism (not shown) that locks movement of the outer surface relative to the support ring 350. The locking mechanism may include a button on the support ring to simplify unlocking and repositioning of the bassinet. Other options include a storage area that hangs from the support ring beneath the bed basket 342.

In this example, the bed basket 342 has a stationary sleep surface or bed 352 about which the wall structure rotates to adjust the wall height. The sleep surface 352 can remain at the same height relative to the ground because the walls adjust rather than the sleep surface (e.g., as opposed to lowering the sleep surface). One benefit of this aspect of the bassinet 340 involves easy child placement and removal during stage two use, especially relative to playards that force a caregiver to bend over to access the low sleeping surface. Alternatively, the child may sleep directly on an inner wall surface instead of a separate sleeping surface or mattress.

FIGS. 20A-20D show another example of a bassinet 360 with height adjustable walls and a stationary sleep surface. The bassinet 360 has a bed basket 362 that includes two octagonal end panels 364 and up to seven rectangular or lengthwise sidewall panels 366 that connect seven of eight corresponding edges of each end panel 364. At least one of the lengthwise panels 366 may be permanently affixed to the end panels 364. The rest of the lengthwise panels 366 can be selectively attached to the end panels 364 in order to (i) adjust the wall height of the bassinet, (ii) change the extent of enclosure of a bassinet interior, and (iii) select the desired access opening size. One or more of the panels 366 may include soft goods, including, for instance, one or more transparent and/or mesh windows. One of the panels 366 is used as a bottom panel that rests on a frame assembly 368 to define the sleeping surface. A number of methods can be employed to accomplish attachment of the lengthwise panels to the end panels including zippers, clips, hook and loop fasteners, snaps, or the like.

Figure 20A:
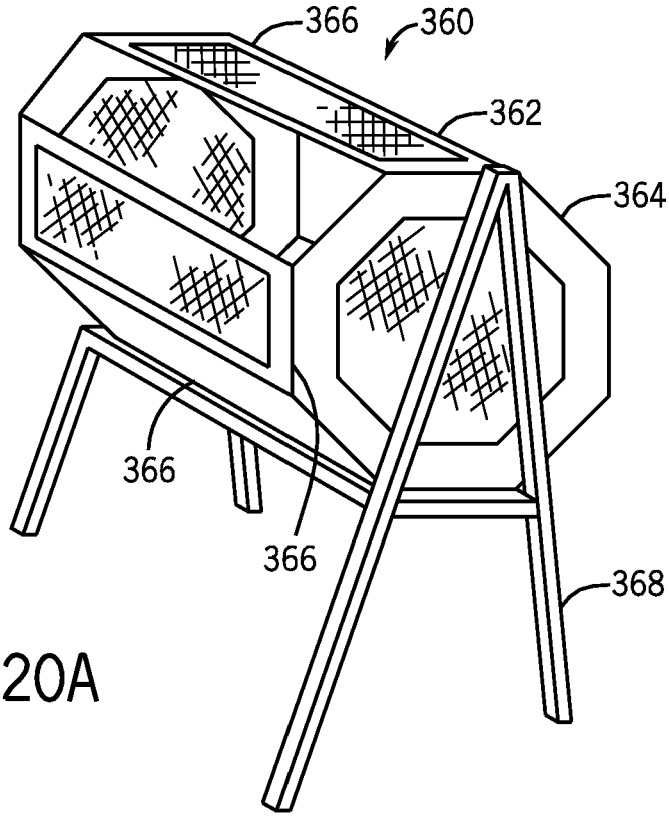
FIGS. 20A-20D are perspective views of still another exemplary bassinet configured for wall height adjustment through rotation and constructed in accordance with several aspects of the disclosure.
Figure 20B:
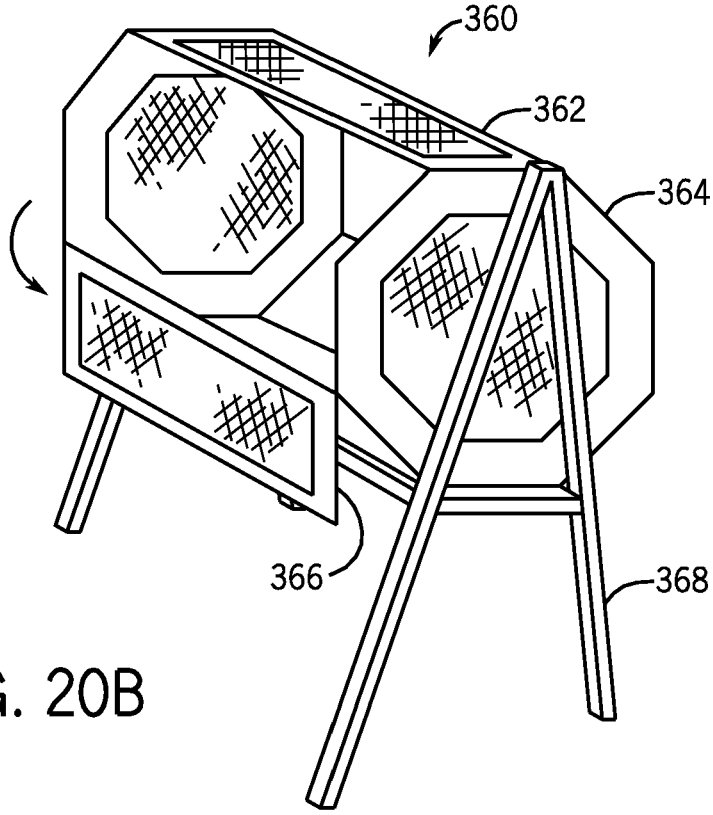
Figure 20C:
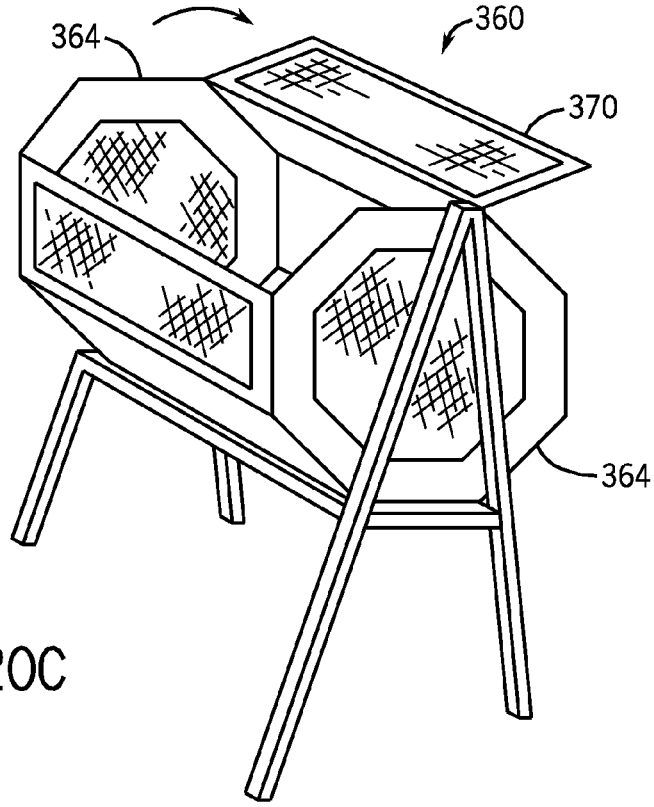
Figure 20D:
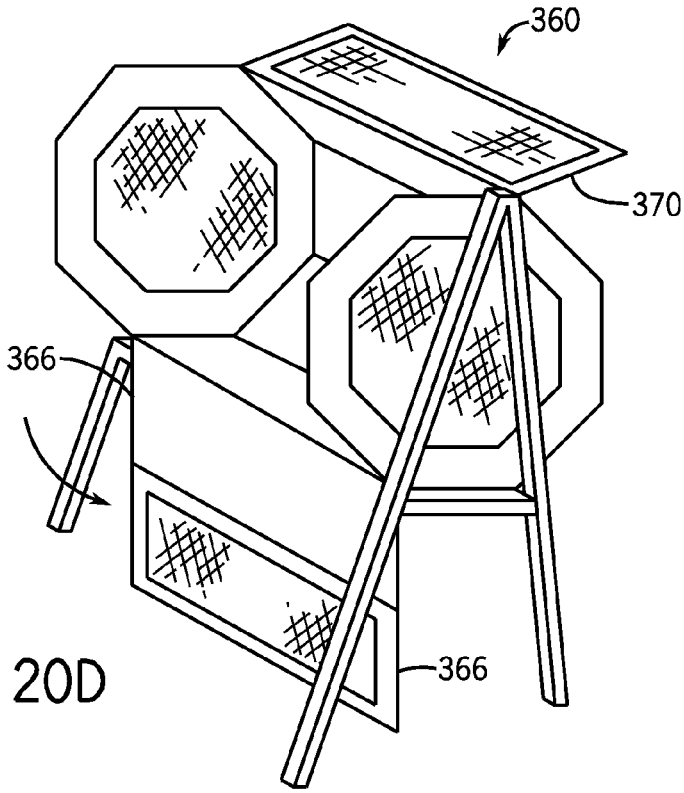

FIG. 20A illustrates the bassinet 360 in an enclosed position with all the lengthwise panels 366 attached to the end panels 364 to create, for instance, a second stage bassinet with a 20 inch low side wall height from the bottom panel to a panel edge. FIG. 20B illustrates the bassinet 360 in a mostly enclosed position with all but one lengthwise panel 366 attached to establish, for instance, a first stage orientation or configuration. FIG. 20C illustrates the bassinet 360 after a top or upper panel 370 is detached from the end panels 364 to establish a second stage configuration. FIG. 20D illustrates one of several other optional configurations with a number of other panels 366 detached to accommodate various needs of the caregiver.

Described above are a number of examples of reconfigurable bassinets that employ height adjustable wall features to comply with existing safety standards and simplify usage of the bassinet. These features and benefits regarding the height of the bassinet walls are provided without adding or taking away other components. Each example may be reconfigured to present bassinet walls in a stage one orientation or configuration as well as a stage two orientation or configuration. In each of the embodiments described herein, the cross beams, braces or rails may be shaped to act as a rocker in either stage one or stage two configurations.

The rotated components or sections of the above-described bassinets may have shapes and sizes that vary considerably from the examples shown. For instance, a substantially elliptical basket may be used in connection with the above-described embodiments, a shape which may present efficient and comfortable proportions for the sleep surface.

The structural and other components of the disclosed bassinets may be constructed of wood, metal (e.g., aluminum), plastic, or any combination thereof. For example, the composition of the above-described basket walls in any of the above-described examples may include an aluminum composition. Each end or other wall of the basket may include an aluminum skeleton or framework wrapped with textiles. Nonetheless, the end walls may be composed of a number of materials, such as wood, steel, plastic or aluminum. Each of the above-described bassinets may have a variety of different soft good arrangements to provide comfort, aesthetic, support, and other aspects, as desired. For instance, the soft goods may include mesh or substantially transparent portions to allow the child and/or caregiver to see through the walls.

The term "bassinet" is used herein in a broad sense to include products, devices, or systems directed to comfortably supporting a sleeping infant.

The disclosed bassinets address the problem of the limited range of infant ages for which typical bassinets are suitable, usually only the 0-3 month period. The disclosed bassinets provide caregivers an alternative to large, full-size cribs or playards for the second stage period that follows. The disclosed bassinets can convert between a first bassinet configuration to a second, "non-full size crib" configuration very easily, without any change in product footprint, and without requiring any additional components. In this way, the disclosed bassinets remain safe for second stage infants and comply with applicable safety standards while providing an infant-appropriate sized product for the caregiver's bedroom or other non-nursery location.

Although certain bassinets have been described herein in accordance with the teachings of the present disclosure, the scope of coverage of this disclosure is not limited thereto. On the contrary, all embodiments of the teachings of the disclosure that fairly fall within the scope of permissible equivalents are disclosed by implication herein.

What is claimed is:

1. A bassinet comprising:

a frame;

a bed basket supported by the frame, the bed basket defining an infant sleep surface;

wherein the frame and the bed basket are pivotably coupled to allow rotation of the bed basket relative to the frame, wherein the bassinet is convertible between a first bassinet configuration and a second bassinet configuration via the rotation of the bed basket relative to the frame, wherein the second bassinet configuration has a greater wall height about the infant sleep surface than the first bassinet configuration, wherein the frame includes a pair of end stands, each stand having a neck section separating first and second sections of each stand, wherein the first section is longer than the second section, and wherein the first section acts as support legs in the first bassinet configuration and wall supports for an infant sleep space in the second bassinet configuration.

2. The bassinet of claim 1, further comprising a pivot shaft that couples the bed basket and the frame.

3. The bassinet of claim 1, further comprising a storage basket, wherein the storage basket includes soft goods suspended from the frame.

4. The bassinet of claim 1, further comprising soft goods that define a storage space in the first bassinet configuration, the soft goods further defining walls of an infant sleep space in the second bassinet configuration.

5. The bassinet of claim 1, further comprising a pair of pivot assemblies, the neck section of each end stand acting as a mount for a respective one of the pivot assemblies.

6. The bassinet of claim 1, wherein the second section acts as support legs in the second bassinet configuration.

7. The bassinet of claim 1, further comprising a storage basket in the first bassinet configuration, the storage basket having a number of walls constructed of soft goods.

8. A bassinet comprising:

a frame;

a bed basket supported by the frame, the bed basket defining an infant sleep surface;

wherein the frame and the bed basket are pivotably coupled to allow the bed basket to rotate relative to the frame to convert between a first bassinet configuration and a second bassinet configuration;

wherein the second bassinet configuration has a greater wall height about the infant sleep surface than the first bassinet configuration;

wherein the bed basket is inverted relative to the frame to convert between the first and second bassinet configurations.

9. A bassinet comprising:

a frame;

a bed basket supported by the frame, the bed basket defining an infant sleep surface;

wherein the frame and the bed basket are pivotably coupled to allow the bed basket to rotate relative to the frame to convert between a first bassinet configuration and a second bassinet configuration;

wherein the second bassinet configuration has a greater wall height about the infant sleep surface than the first bassinet configuration;

wherein the frame comprises a pair of stands, and wherein each stand is inverted relative to a rest surface to convert between the first and second bassinet configurations.

10. The bassinet of claim 9, wherein the bed basket is inverted relative to each stand to convert between the first and second bassinet configurations.

11. A bassinet comprising:

a frame;

a bed basket supported by the frame, the bed basket defining an infant sleep surface;

a storage basket, wherein the storage basket includes soft goods suspended from the frame;

wherein the frame and the bed basket are pivotably coupled to allow the bed basket to rotate relative to the frame to convert between a first bassinet configuration and a second bassinet configuration;

wherein the second bassinet configuration has a greater wall height about the infant sleep surface than the first bassinet configuration;

wherein the bed basket is inverted relative to the frame and the frame is inverted relative to a rest surface to convert from the first bassinet configuration to the second bassinet configuration in which the soft goods of the storage basket form a wall structure about the infant sleep surface.

12. A bassinet comprising:

a frame;

a bed basket supported by the frame, the bed basket defining an infant sleep surface, wherein the frame and the bed basket are pivotably coupled to allow rotation of the bed basket relative to the frame, wherein the bassinet is convertible between a first bassinet configuration and a second bassinet configuration via the rotation of the bed basket relative to the frame, wherein the second bassinet configuration has a greater wall height about the infant sleep surface than the first bassinet configuration, wherein the bassinet further comprises soft goods that define a storage space in the first bassinet configuration, the soft goods further defining walls of an infant sleep space in the second bassinet configuration, wherein the bassinet further comprises a removable mattress pad placed on top of the soft goods of the storage space in the second bassinet configuration in which the soft goods are flattened against a bottom of the bed basket.

13. A bassinet comprising:

a frame;

a bed basket supported by the frame, the bed basket defining an infant sleep surface, wherein the frame and the bed basket are pivotably coupled to allow rotation of the bed basket relative to the frame, wherein the bassinet is convertible between a first bassinet configuration and a second bassinet configuration via the rotation of the bed basket relative to the frame, wherein the second bassinet configuration has a greater wall height about the infant sleep surface than the first bassinet configuration, and wherein the bassinet further comprises a storage basket in the first bassinet configuration, wherein the storage basket has a number of walls supported by the frame, each storage basket wall being aligned with a respective wall of the bed basket in the second bassinet configuration to form an extension of the bed basket.

14. A bassinet comprising:

a frame;

a bed basket supported by the frame, the bed basket defining an infant sleep surface, wherein the frame and the bed basket are pivotably coupled to allow rotation of the bed basket relative to the frame, wherein the bassinet is convertible between a first bassinet configuration and a second bassinet configuration via the rotation of the bed basket relative to the frame, wherein the second bassinet configuration has a greater wall height about the infant sleep surface than the first bassinet configuration, wherein the bassinet further comprises a storage basket in the first bassinet configuration, the storage basket having a number of walls constructed of soft goods, wherein each storage basket wall includes exterior and interior layers of soft goods, and wherein the frame includes a support rod at a transition between the exterior and interior layers.

15. The bassinet of claim 14, wherein the interior layer drops downward from the support rod to define a storage space of the storage basket.

16. The bassinet of claim 14, wherein the interior layer is sized to match dimensions of the bed basket to allow the interior layer to be pushed downward into, and flattened against a bottom of, the bed basket in the second bassinet configuration.

17. The bassinet of claim 16, further comprising a mattress pad disposed on top of the interior layer of the storage basket in the second bassinet configuration.

18. A bassinet comprising:

a frame;

a bed basket supported by the frame, the bed basket defining an infant sleep surface, wherein the frame and the bed basket are pivotably coupled to allow rotation of the bed basket relative to the frame, wherein the bassinet is convertible between a first bassinet configuration and a second bassinet configuration via the rotation of the bed basket relative to the frame, wherein the second bassinet configuration has a greater wall height about the infant sleep surface than the first bassinet configuration, and wherein the bassinet further comprises a storage basket supported by the frame in the first bassinet configuration, the storage basket having a top rim spaced from a bottom of the bed basket by a distance to allow the bed basket to rotate into an inverted position.

19. The bassinet of claim 18, wherein the top rim of the storage basket is positioned in proximity to a top rim of the bed basket when the bed basket is in the inverted position.

* * * * *